US011562623B2

(12) United States Patent
Tam et al.

(10) Patent No.: US 11,562,623 B2
(45) **Date of Patent: *Jan. 24, 2023**

(54) GAMING DEVICE WITH PRIZE SYMBOLS

(71) Applicant: Aristocrat Technologies Australia Pty Limited, North Ryde (AU)

(72) Inventors: Billy Tam, Lindfield (AU); Antoon Visser, Coogee (AU); Lipi Gupta, Newington (AU); Alessandro Sidoti, Cromer (AU); Karen Kendall, Toongabbie (AU)

(73) Assignee: Aristocrat Technologies Australia Pty Limited, North Ryde (AU)

( * ) Notice: Subject to any disclaimer, the term of this patent is extended or adjusted under 35 U.S.C. 154(b) by 0 days.

This patent is subject to a terminal disclaimer.

(21) Appl. No.: 17/540,022

(22) Filed: Dec. 1, 2021

(65) Prior Publication Data

US 2022/0092935 A1 Mar. 24, 2022

Related U.S. Application Data

(63) Continuation of application No. 16/523,807, filed on Jul. 26, 2019, now Pat. No. 11,210,901.

(30) Foreign Application Priority Data

May 9, 2019 (AU) ..... 2019203273

(51) Int. Cl.
*G07F 17/32* (2006.01)

(52) U.S. Cl.
CPC ..... *G07F 17/3258* (2013.01); *G07F 17/3213* (2013.01)

(58) Field of Classification Search
None
See application file for complete search history.

(56) References Cited

U.S. PATENT DOCUMENTS

| | | | |
|---|---|---|---|
| D196,564 | S | 10/1963 | Miller |
| D225,517 | S | 12/1972 | Coplon |
| D248,570 | S | 7/1978 | Smith |
| D248,982 | S | 8/1978 | Cook |
| 4,293,898 | A | 10/1981 | Budnovitch |
| 4,739,594 | A | 4/1988 | Langford |

(Continued)

OTHER PUBLICATIONS

Notice of Allowance dated Jun. 13, 2022 for U.S. Appl. No. 29/722,758 (pp. 1-7).

(Continued)

*Primary Examiner* — James S. McClellan
*Assistant Examiner* — Peter J Iannuzzi
(74) *Attorney, Agent, or Firm* — Brownstein Hyatt Farber Schreck, LLP

(57) ABSTRACT

A gaming device comprises a display, a processor, and a memory storing instructions. When the instructions are executed by the processor, the instructions cause the processor to select a plurality of symbols from each of a plurality of reel strips, wherein at least one of the plurality of reel strips comprises a designated symbol, control the display to display the selected symbols of each of the plurality of reel strips in a corresponding column of symbol positions, and evaluate the selected symbols for winning combinations. The evaluation includes upon the selected symbols including the designated symbol and a first prize symbol, awarding a first prize, and upon the selected symbols including the designated symbol and a second prize symbol, awarding a second prize.

20 Claims, 25 Drawing Sheets

(56) References Cited

U.S. PATENT DOCUMENTS

| | | | | |
|---|---|---|---|---|
| D370,313 | S | 5/1996 | Nottingham | |
| 5,524,458 | A | 6/1996 | Buchner | |
| 5,857,910 | A | 1/1999 | Watanabe | |
| D439,282 | S | 3/2001 | Yamaguchi | |
| D537,887 | S | 3/2007 | Gardiner | |
| D548,288 | S | 8/2007 | Baerlocher | |
| D563,572 | S | 3/2008 | Lukacs | |
| D572,770 | S | 7/2008 | Seelig | |
| D592,708 | S | 5/2009 | Hsu | |
| D597,144 | S | 7/2009 | Myers | |
| D605,780 | S | 12/2009 | Uffner | |
| D613,343 | S | 4/2010 | Inoue | |
| D614,244 | S | 4/2010 | Inoue | |
| 7,699,316 | B2 | 4/2010 | Seelig | |
| 7,727,065 | B2 | 6/2010 | Seelig | |
| 8,337,298 | B2 * | 12/2012 | Baerlocher | G07F 17/3267 463/16 |
| D705,363 | S | 5/2014 | Inoue | |
| D707,302 | S | 6/2014 | Inoue | |
| D714,392 | S | 9/2014 | Arabian | |
| D714,875 | S | 10/2014 | Wudtke | |
| D759,903 | S | 6/2016 | Justiniano | |
| D810,830 | S | 2/2018 | Sharp | |
| 9,937,411 | B2 | 4/2018 | Okuaki | |
| D827,154 | S | 8/2018 | Lee | |
| D847,257 | S | 4/2019 | Phang | |
| D880,605 | S | 4/2020 | Bussey | |
| 11,210,901 | B2 * | 12/2021 | Tam | G07F 17/3213 |
| 2011/0053676 | A1 * | 3/2011 | Wolf | G07F 17/3295 463/20 |
| 2011/0281641 | A1 | 11/2011 | Weller | |
| 2012/0266104 | A1 | 10/2012 | Shah | |
| 2014/0274313 | A1 | 9/2014 | Bala | |
| 2017/0294147 | A1 | 10/2017 | Lin | |
| 2018/0225915 | A1 * | 8/2018 | Hughes | G07F 17/3213 |
| 2019/0114873 | A1 * | 4/2019 | Minor | G07F 17/3244 |
| 2020/0352014 | A1 | 11/2020 | Matsumoto | |
| 2021/0208764 | A1 | 7/2021 | Xing | |

OTHER PUBLICATIONS

Office Action dated Jul. 8, 2020 for U.S. Appl. No. 15/523,807 (pp. 1-10).

Office Action dated Jul. 20, 2021 for U.S. Appl. No. 29/722,769 (pp. 1-10).

Oncpcare store pavilion, announced 2019 [online], [site visited Jul. 12, 2021]. Available on internet, URL:https://www.amazon.com/Pavilion-Aquarium-Decorati on-Landscape-Accessories/dp/B07QVZVJ5O/ref=sr_1_77?dchild=1&keywords =pagoda+statue &qid= 1622728091 &sr=8-77 (Year: 2019).

Backyard discovery store, announced 2016 [online], [site visited Jul. 12, 2021]. Available on internet, URL: Amazon.com: Backyard Discovery 12' by 10' Cedar Pergola: Garden & Outdoor (Year: 2016).

Wowpaperart, announced 2016[online], [site visited Jul. 12, 2021]. Available on internet, URL:Amazon.com: Torii Gate Japan—3D Pop Up Greeting Card for All Occasions—Gift for Family, Friends, Loved Ones—Fold Flat, Envelope : Office Products (Year: 2016).

Office Action dated Jul. 20, 2021 for U.S. Appl. No. 29/722,797 (pp. 1-9).

Backyard discovery store, announced 2019 [online], [site visited Jul. 13, 2021]. Available on internet, URL:Amazon.com: Backyard Discovery 12 by I(Y Cedar Pergola: Garden & Outdoor (Year: 2016).

Office Action dated Sep. 14, 2021 for U.S. Appl. No. 29/722,769 (pp. 1-7).

Office Action dated Oct. 25, 2021 for U.S. Appl. No. 29/722,758 (pp. 1-6).

Office Action (Notice of Allowance and Fees Due (PTOL-85)) dated Sep. 1, 2021 for U.S. Appl. No. 16/523,807 (pp. 1-7).

Dragon mart dubai emirate, announced 2015 [online], [site visited Jun. 2, 2021]. Available on internet, URL: https://www.tripadvisor.com.vn/LocationPhotoDirectLink-g295424-d1221662-i158091175-Dragon_Mart-Dubai_Emirate_of_Dubai.html (Year: 2015).

Office Action dated Sep. 14, 2021 for U.S. Appl. No. 29/722,797 (pp. 1-5).

Notice of Allowance dated Dec. 13, 2021 for U.S. Appl. No. 29/722,769 (pp. 1-6).

Notice of Allowance dated Dec. 13, 2021 for U.S. Appl. No. 29/722,797 (pp. 1-6).

Office Action dated Feb. 15, 2022 for U.S. Appl. No. 29/722,758 (pp. 1-9).

* cited by examiner

600

| | Reel strip position | Reel 1 (641) | Reel 2 (642) | Reel 3 (643) | Reel 4 (644) | Reel 5 (645) |
|---|---|---|---|---|---|---|
| 601 | 1 | Pic 1 | 10 | Pic 3 | Q | Pic 1 |
| 602 | 2 | Dynamic | Q | K | A | 10 |
| 603 | 3 | J | K | 10 | 10 | A |
| 604 | 4 | Scat | Pic 1 | Pic 2 | Scat | Bonus |
| 605 | 5 | Q | A | Q | Pic 2 | Pic 2 |
| 606 | 6 | 10 | Pic 2 | K | J | A |
| 607 | 7 | Dynamic | Pic 5 | K | Pic 1 | Q |
| 608 | 8 | Pic 5 | J | Wild | K | Pic 3 |
| 609 | 9 | A | Q | 10 | Q | 9 |
| 610 | 10 | 9 | A | Pic 1 | K | J |
| 611 | 11 | Pic 2 | Pic 5 | 9 | Pic 5 | Bonus |
| 612 | 12 | 10 | 9 | Pic 3 | Pic 1 | K |
| 613 | 13 | Dynamic | K | A | Q | K |
| 614 | 14 | Pic 3 | 9 | Q | Pic 4 | Bonus |
| 615 | 15 | K | Scat | J | Pic 2 | 9 |
| 616 | 16 | K | 10 | 10 | 9 | Scat |
| 617 | 17 | J | Wild | 10 | A | K |
| 618 | 18 | Pic 4 | Pic 2 | Scat | A | Pic 5 |
| 619 | 19 | Pic 4 | Q | Pic 5 | 10 | Pic 1 |
| 620 | 20 | Pic 1 | Q | J | K | 10 |
| 621 | 21 | 10 | Pic 5 | Pic 3 | Pic 3 | K |
| 622 | 22 | J | J | Pic 4 | Pic 3 | Pic 2 |
| 623 | 23 | Dynamic | K | K | 10 | Q |
| 624 | 24 | Dynamic | 9 | 10 | J | Wild |
| 625 | 25 | Pic 5 | Pic 3 | 9 | Pic 5 | Bonus |
| 626 | 26 | A | Pic 4 | Pic 3 | 9 | Pic 4 |
| 627 | 27 | 10 | Scat | Q | 10 | Pic 4 |
| 628 | 28 | Pic 4 | K | Pic 2 | Wild | 10 |
| 629 | 29 | 9 | 10 | J | Q | Pic 5 |
| 630 | 30 | Q | Q | Pic 4 | K | J |

661 662 663 664 665 651 652 653 654

FIG. 6

600A

| | Reel strip position | Reel 1 (641A) | Reel 2 (642) | Reel 3 (643) | Reel 4 (644) | Reel 5 (645) |
|---|---|---|---|---|---|---|
| 601 | 1 | Pic 1 | 10 | Pic 3 | Q | Pic 1 |
| 602 (661A) | 2 | JADE | Q | K | A | 10 |
| 603 | 3 | J | K | 10 | 10 | A |
| 604 | 4 | Scat | Pic 1 | Pic 2 | Scat | Bonus (651) |
| 605 | 5 | Q | A | Q | Pic 2 | Pic 2 |
| 606 | 6 | 10 | Pic 2 | K | J | A |
| 607 (662A) | 7 | 1688 Credits | Pic 5 | K | Pic 1 | Q |
| 608 | 8 | Pic 5 | J | Wild | K | Pic 3 |
| 609 | 9 | A | Q | 10 | Q | 9 |
| 610 | 10 | 9 | A | Pic 1 | K | J |
| 611 | 11 | Pic 2 | Pic 5 | 9 | Pic 5 | Bonus (652) |
| 612 | 12 | 10 | 9 | Pic 3 | Pic 1 | K |
| 613 (663A) | 13 | 88 Credits | K | A | Q | K |
| 614 | 14 | Pic 3 | 9 | Q | Pic 4 | Bonus (653) |
| 615 | 15 | K | Scat | J | Pic 2 | 9 |
| 616 | 16 | K | 10 | 10 | 9 | Scat |
| 617 | 17 | J | Wild | 10 | A | K |
| 618 | 18 | Pic 4 | Pic 2 | Scat | A | Pic 5 |
| 619 | 19 | Pic 4 | Q | Pic 5 | 10 | Pic 1 |
| 620 | 20 | Pic 1 | Q | J | K | 10 |
| 621 | 21 | 10 | Pic 5 | Pic 3 | Pic 3 | K |
| 622 | 22 | J | J | Pic 4 | Pic 3 | Pic 2 |
| 623 (664A) | 23 | 888 Credits | K | K | 10 | Q |
| 624 (665A) | 24 | GOLD | 9 | 10 | J | Wild |
| 625 | 25 | Pic 5 | Pic 3 | 9 | Pic 5 | Bonus (654) |
| 626 | 26 | A | Pic 4 | Pic 3 | 9 | Pic 4 |
| 627 | 27 | 10 | Scat | Q | 10 | Pic 4 |
| 628 | 28 | Pic 4 | K | Pic 2 | Wild | 10 |
| 629 | 29 | 9 | 10 | J | Q | Pic 5 |
| 630 | 30 | Q | Q | Pic 4 | K | J |

FIG. 7

800

| | Reel strip position | Reel 1 (841) | Reel 2 (842) | Reel 3 (843) | Reel 4 (844) | Reel 5 (845) |
|---|---|---|---|---|---|---|
| 801 | 1 | Pic 1 | 10 | Pic 3 | Dynamic (864) | Pic 1 |
| 802 | 2 | Dynamic (851) | Q | K | A | 10 |
| 803 | 3 | J | K | 10 | Dynamic (865) | A |
| 804 | 4 | Scat | Pic 1 | Pic 2 | Scat | Dynamic (869) |
| 805 | 5 | Q | A | Q | Pic 2 | Pic 2 |
| 806 | 6 | 10 | Pic 2 | Dynamic (860) | J | A |
| 807 | 7 | Dynamic (852) | Pic 5 | K | Pic 1 | Q |
| 808 | 8 | Pic 5 | J | Wild | K | Pic 3 |
| 809 | 9 | A | Dynamic (856) | 10 | Q | 9 |
| 810 | 10 | 9 | A | Pic 1 | Dynamic (866) | J |
| 811 | 11 | Pic 2 | Pic 5 | 9 | Pic 5 | Dynamic (870) |
| 812 | 12 | 10 | 9 | Pic 3 | Pic 1 | K |
| 813 | 13 | Dynamic (853) | Dynamic (857) | A | Q | K |
| 814 | 14 | Pic 3 | 9 | Q | Pic 4 | Dynamic (871) |
| 815 | 15 | K | Scat | J | Pic 2 | 9 |
| 816 | 16 | K | 10 | Dynamic (861) | 9 | Scat |
| 817 | 17 | J | Wild | 10 | Dynamic (867) | K |
| 818 | 18 | Pic 4 | Pic 2 | Scat | A | Pic 5 |
| 819 | 19 | Pic 4 | Q | Pic 5 | 10 | Pic 1 |
| 820 | 20 | Pic 1 | Dynamic (858) | J | K | 10 |
| 821 | 21 | 10 | Pic 5 | Pic 3 | Pic 3 | K |
| 822 | 22 | J | J | Pic 4 | Pic 3 | Pic 2 |
| 823 | 23 | Dynamic (854) | K | Dynamic | Dynamic (868) | Q |
| 824 | 24 | Dynamic (855) | 9 | 10 | J (862) | Wild |
| 825 | 25 | Pic 5 | Pic 3 | 9 | Pic 5 | Dynamic (872) |
| 826 | 26 | A | Pic 4 | Dynamic | 9 (863) | Pic 4 |
| 827 | 27 | 10 | Scat | Q | 10 | Pic 4 |
| 828 | 28 | Pic 4 | Dynamic | Pic 2 (859) | 28 | 10 |
| 829 | 29 | 9 | 10 | J | Q | Pic 5 |
| 830 | 30 | Q | Q | Pic 4 | K | J |

FIG. 8

800A

| | Reel strip position | Reel 1 (841) | Reel 2 (842A) | Reel 3 (843) | Reel 4 (844) | Reel 5 (845) |
|---|---|---|---|---|---|---|
| 801 | 1 | Pic 1 | 10 | Pic 3 | Dynamic | Pic 1 |
| 802 | 2 | Dynamic | Q | K | A | 10 |
| 803 | 3 | J | K | 10 | Dynamic | A |
| 804 | 4 | Scat | Pic 1 | Pic 2 | Scat | Dynamic |
| 805 | 5 | Q | A | Q | Pic 2 | Pic 2 |
| 806 | 6 | 10 | Pic 2 | Dynamic | J | A |
| 807 | 7 | Dynamic | Pic 5 | K | Pic 1 | Q |
| 808 | 8 | Pic 5 | J | Wild | K | Pic 3 |
| 809 | 9 | A | Bonus | 10 | Q | 9 |
| 810 | 10 | 9 | A | Pic 1 | Dynamic | J |
| 811 | 11 | Pic 2 | Pic 5 | 9 | Pic 5 | Dynamic |
| 812 | 12 | 10 | 9 | Pic 3 | Pic 1 | K |
| 813 | 13 | Dynamic | Bonus | A | Q | K |
| 814 | 14 | Pic 3 | 9 | Q | Pic 4 | Dynamic |
| 815 | 15 | K | Scat | J | Pic 2 | 9 |
| 816 | 16 | K | 10 | Dynamic | 9 | Scat |
| 817 | 17 | J | Pic 3 | 10 | Dynamic | K |
| 818 | 18 | Pic 4 | Wild | Scat | A | Pic 5 |
| 819 | 19 | Pic 4 | Q | Pic 5 | 10 | Pic 1 |
| 820 | 20 | Pic 1 | Bonus | J | K | 10 |
| 821 | 21 | 10 | Pic 5 | Pic 3 | Pic 3 | K |
| 822 | 22 | J | J | Pic 4 | Pic 3 | Pic 2 |
| 823 | 23 | Dynamic | K | Dynamic | Dynamic | Q |
| 824 | 24 | Dynamic | 9 | 10 | J | Wild |
| 825 | 25 | Pic 5 | Pic 3 | 9 | Pic 5 | Dynamic |
| 826 | 26 | A | Pic 4 | Dynamic | 9 | Pic 4 |
| 827 | 27 | 10 | Scat | Q | 10 | Pic 4 |
| 828 | 28 | Pic 4 | Bonus | Pic 2 | Wild | 10 |
| 829 | 29 | 9 | 10 | J | Q | Pic 5 |
| 830 | 30 | Q | Q | Pic 4 | K | J |

856A 857A 858A 859A

FIG. 9

GAMING DEVICE WITH PRIZE SYMBOLS

CROSS-REFERENCE TO RELATED APPLICATIONS

This application is a continuation of U.S. patent application Ser. No. 16/523,807, filed Jul. 26, 2019, the disclosure of which is hereby incorporated by reference. U.S. patent application Ser. No. 16/523,807 claims priority to Australian Pat. App. No. 2019203273, filed May 9, 2019, the disclosure of which is hereby incorporated by reference.

FIELD

The disclosed technology relates to a gaming device with prize symbols.

BACKGROUND

Electronic gaming machines ("EGMs") or gaming devices provide a variety of wagering games such as slot games, video poker games, video blackjack games, roulette games, video bingo games, keno games and other types of games that are frequently offered at casinos and other locations. Play on EGMs typically involves a player establishing a credit balance by inputting money, or another form of monetary credit, and placing a monetary wager (from the credit balance) on one or more outcomes of an instance (or single play) of a primary or base game. In many games, a player may qualify for secondary games or bonus rounds by attaining a certain winning combination or triggering event in the base game. Secondary games provide an opportunity to win additional game instances, credits, awards, jackpots, progressives, etc. Awards from any winning outcomes are typically added back to the credit balance and can be provided to the player upon completion of a gaming session or when the player wants to "cash out."

"Slot" type games are often displayed to the player in the form of various symbols arrayed in a row-by-column grid or matrix. Specific matching combinations of symbols along predetermined paths (or paylines) through the matrix indicate the outcome of the game. The display typically highlights winning combinations/outcomes for ready identification by the player. Matching combinations and their corresponding awards are usually shown in a "pay-table" which is available to the player for reference. Often, the player may vary his/her wager to include differing numbers of paylines and/or the amount bet on each line. By varying the wager, the player may sometimes alter the frequency or number of winning combinations, frequency or number of secondary games, and/or the amount awarded.

Typical games use a random number generator (RNG) to randomly determine the outcome of each game. The game is designed to return a certain percentage of the amount wagered back to the player (RTP=return to player) over the course of many plays or instances of the game. The RTP and randomness of the RNG are critical to ensuring the fairness of the games and are therefore highly regulated. Upon initiation of play, the RNG randomly determines a game outcome and symbols are then selected which correspond to that outcome. Notably, some games may include an element of skill on the part of the player and are therefore not entirely random.

SUMMARY

Example embodiments of the disclosed technology provide a gaming device, a method of operating a gaming device and a gaming system wherein some of the symbols of at least one reel are prize symbols and some of the symbols of at least one other reel are designated symbols. Prizes on the prize symbols are awarded when they are selected concurrently with the designated symbol. In one example, the prize symbols include prize symbols for two progressive prizes, such that one or both progressive prizes will be awarded if their prize symbols are selected when the designated symbol is selected. In certain embodiments, the reel strips include a number of configurable reel strips having one or more symbols, including the designated symbol, and the one or more symbols dynamically change based on a level of a received wager.

In a related embodiment, the two progressive prizes are each set to a same initial value and increment at the same rate. If one is awarded, it is reset. The progressive prizes continue to increment at the same rate. Typically, one of the progressive prizes will be available to win at an incremented value relative to the other progressive prize.

In an example embodiment, a gaming device comprises a display, a processor, and a memory storing instructions. When the instructions are executed by the processor, they cause the processor to select a plurality of symbols from each of a plurality of reel strips, wherein at least one of the plurality of reel strips comprises a designated symbol, control the display to display the selected symbols of each of the plurality of reel strips in a corresponding column of symbol positions, and evaluate the selected symbols for winning combinations. The evaluation includes upon the selected symbols including the designated symbol and a first prize symbol, awarding a first prize, and upon the selected symbols including the designated symbol and a second prize symbol, awarding a second prize.

In another example embodiment, there is provided a method of operating a gaming device comprising a display. The method comprises selecting a plurality of symbols from each of a plurality of reel strips, wherein at least one of the plurality of reel strips comprises a designated symbol, controlling the display to display the selected symbols of each of the plurality of reel strips in a corresponding column of symbol positions, and evaluating the selected symbols for winning combinations. Evaluating the selected symbols includes upon the selected symbols including the designated symbol and a first prize symbol, awarding a first prize, and upon the selected symbols including the designated symbol and a second prize symbol, awarding a second prize.

In another example embodiment, there is provided a system comprising a display, one or more processors, and at least one memory storing instructions. When the instructions are executed by the one or more processors, cause the one or more processors to select a plurality of symbols from each of a plurality of reel strips, wherein at least one of the plurality of reel strips comprises a designated symbol, control the display to display the selected symbols of each of the plurality of reel strips in a corresponding column of symbol positions, and evaluate the selected symbols for winning combinations. The evaluation includes upon the selected symbols including the designated symbol and a first prize symbol, awarding a first prize, and upon the selected symbols including the designated symbol and a second prize symbol, awarding a second prize.

In another example embodiment, there is provided a gaming device comprises a display, a processor, and a memory storing instructions. When the instructions are executed by the processor, the instructions cause the processor to set an initial value of a first prize and a second prize at a same value and increment each of the first prize and the second prize at a same rate based on wagers received by the gaming device. In response to receipt of an initiation instruction (e.g. receipt of wager, press of a play button), the instructions cause the processor to select a plurality of symbols from each of a plurality of reel strips, control the display to display the selected symbols of each of the plurality of reel strips in a corresponding column of symbol positions, evaluate the selected symbols for winning combinations including a winning combination for awarding a first prize and a winning combination for awarding a second prize, and upon awarding one of the first prize and the second prize, reset the respective one of the first and the second prize to the initial prize. The instructions also cause the processor to continue to increment each of the first prize and the second prize at the same rate based on subsequent wagers received by the gaming device.

In another example embodiment, there is provided a method of operating a gaming device comprising a display. The method comprises setting an initial value of a first prize and a second prize at a same value and incrementing each of the first prize and the second prize at a same rate based on wagers received by the gaming device. Responsive to receipt of an initiation instruction, the method comprises selecting a plurality of symbols from each of a plurality of reel strips, controlling the display to display the selected symbols of each of the plurality of reel strips in a corresponding column of symbol positions, evaluating the selected symbols for winning combinations including a winning combination for awarding a first prize and a winning combination for awarding a second prize; and upon awarding one of the first prize and the second prize, resetting the respective one of the first and the second prize to the initial prize. The method also comprises continuing to increment each of the first prize and the second prize at the same rate based on subsequent wagers received by the gaming device.

In another example embodiment, there is provided a system comprising a display, one or more processors, and at least one memory storing instructions. When the instructions are executed by the one or more processors, cause the one or more processors to set an initial value of a first prize and a second prize at a same value and increment each of the first prize and the second prize at a same rate based on wagers received by the gaming system. In response to receipt of an initiation instruction (e.g. receipt of wager, press of a play button), the instructions cause the one or more processors to select a plurality of symbols from each of a plurality of reel strips, control the display to display the selected symbols of each of the plurality of reel strips in a corresponding column of symbol positions, evaluate the selected symbols for winning combinations including a winning combination for awarding a first prize and a winning combination for awarding a second prize, and upon awarding one of the first prize and the second prize, reset the respective one of the first and the second prize to the initial prize. The instructions also cause the one or more processors to continue to increment each of the first prize and the second prize at the same rate based on subsequent wagers received by the gaming device.

BRIEF DESCRIPTION OF THE DRAWINGS

FIG. 6 illustrates an example reel strip layout prior to configuration.

FIG. 7 illustrates the reel strip layout of FIG. 6 after configuration.

FIG. 8 illustrates another example reel strip layout prior to configuration.

FIG. 9 illustrates the reel strip layout of FIG. 8 after configuration.

DETAILED DESCRIPTION

Figure 1:
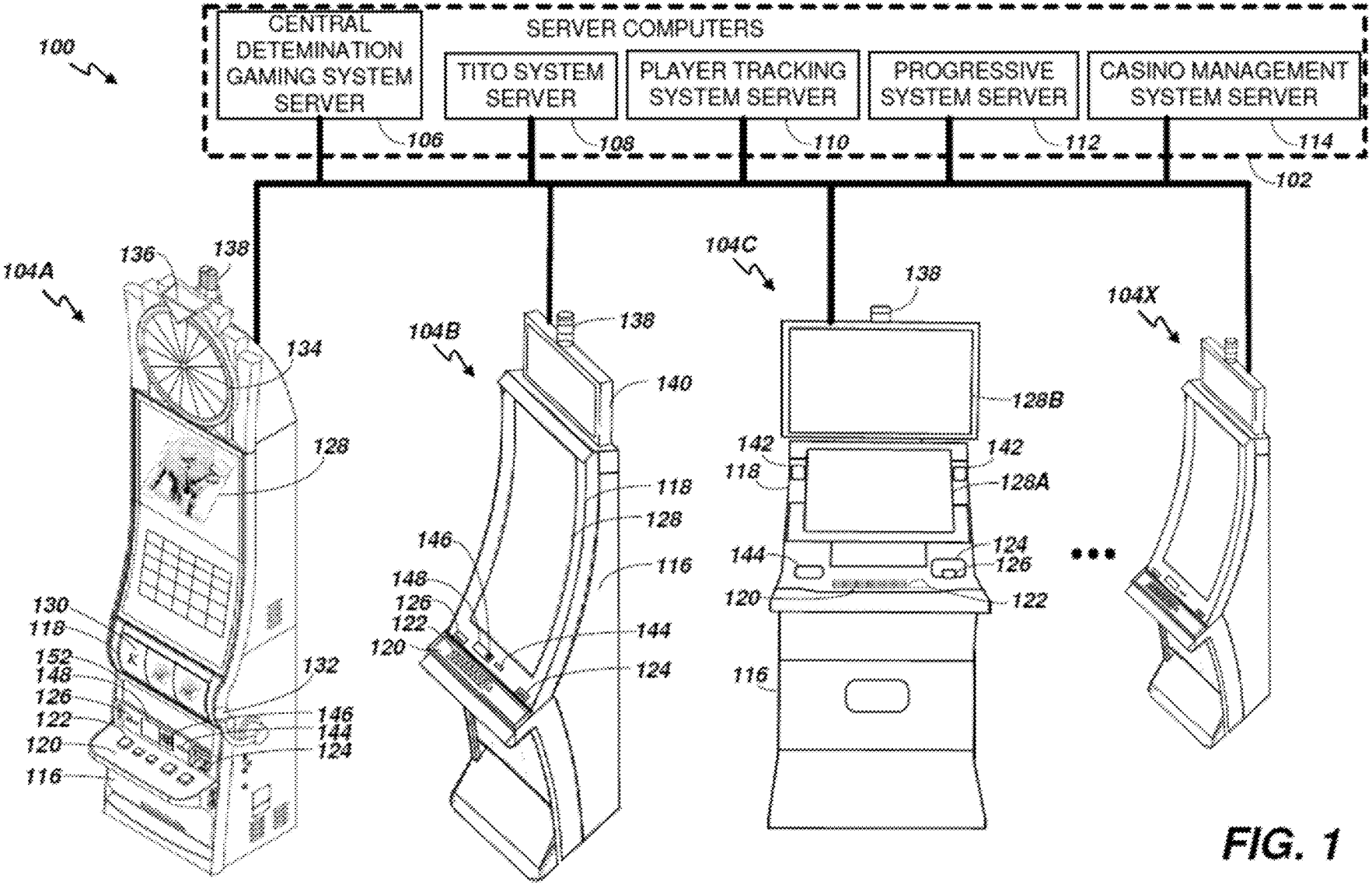
FIG. 1 is an exemplary diagram showing several EGMs networked with various gaming related servers.

FIG. 1 illustrates several different models of EGMs which may be networked to various gaming related servers. The disclosed technology can be configured to work as a system 100 in a gaming environment including one or more server computers 102 (e.g., slot servers of a casino) that are in communication, via a communications network, with one or more gaming devices 104A-104X (EGMs, slots, video poker, bingo machines, etc.). The gaming devices 104A-104X may alternatively be portable and/or remote gaming devices such as, but not limited to, a smart phone, a tablet, a laptop, or a game console.

Communication between the gaming devices 104A-104X and the server computers 102, and among the gaming devices 104A-104X, may be direct or indirect, such as over the Internet through a website maintained by a computer on a remote server or over an online data network including commercial online service providers, Internet service providers, private networks, and the like. In other embodiments, the gaming devices 104A-104X may communicate with one another and/or the server computers 102 over RF, cable TV, satellite links and the like.

In some embodiments, server computers 102 may not be necessary and/or preferred. For example, the disclosed technology may, in one or more embodiments, be practiced on a stand-alone gaming device such as gaming device 104A, gaming device 104B or any of the other gaming devices 104C-104X. However, it is typical to find multiple EGMs connected to networks implemented with one or more of the different server computers 102 described herein.

The server computers 102 may include a central determination gaming system server 106, a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, game outcomes may be generated on a central determination gaming system server 106 and then transmitted over the network to any of a group of remote terminals or remote gaming devices 104A-104X that utilize the game outcomes and display the results to the players.

Gaming device 104A is often of a cabinet construction which may be aligned in rows or banks of similar devices for placement and operation on a casino floor. The gaming device 104A often includes a main door 116 which provides access to the interior of the cabinet. Gaming device 104A typically includes a button area or button deck 120 accessible by a player that is configured with input switches or buttons 122, an access channel for a bill validator 124, and/or an access channel for a ticket printer 126.

In FIG. 1, gaming device 104A is shown as a Relm XL™ model gaming device manufactured by Aristocrat® Technologies, Inc. As shown, gaming device 104A is a reel machine having a gaming display area 118 comprising a number (typically 3 or 5) of mechanical reels 130 with various symbols displayed on them. The reels 130 are independently spun and stopped to show a set of symbols within the gaming display area 118 which may be used to determine an outcome to the game. In embodiments where the reels are mechanical, mechanisms can be employed to implement greater functionality. For example, the boundaries of the gaming display area boundaries of the gaming display area 118 may be defined by one or more mechanical shutters controllable by a processor. The mechanical shutters may be controlled to open and close, to correspondingly reveal and conceal more or fewer symbol positions from the mechanical reels 130. For example, a top boundary of the gaming display area 118 may be raised by moving a corresponding mechanical shutter upwards to reveal an additional row of symbol positions on stopped mechanical reels. Further, a transparent or translucent display panel may be overlaid on the gaming display area 118 and controlled to override or supplement what is displayed on one or more of the mechanical reel(s).

In many configurations, the gaming machine 104A may have a main display 128 (e.g., video display monitor) mounted to, or above, the gaming display area 118. The main display 128 can be a high-resolution LCD, plasma, LED, or OLED panel which may be flat or curved as shown, a cathode ray tube, or other conventional electronically controlled video monitor.

In some embodiments, the bill validator 124 may also function as a "ticket-in" reader that allows the player to use a casino issued credit ticket to load credits onto the gaming device 104A (e.g., in a cashless ticket ("TITO") system). In such cashless embodiments, the gaming device 104A may also include a "ticket-out" printer 126 for outputting a credit ticket when a "cash out" button is pressed. Cashless TITO systems are well known in the art and are used to generate and track unique bar-codes or other indicators printed on tickets to allow players to avoid the use of bills and coins by loading credits using a ticket reader and cashing out credits using a ticket-out printer 126 on the gaming device 104A. In some embodiments a ticket reader can be used which is only capable of reading tickets. In some embodiments, a different form of token can be used to store a cash value, such as a magnetic stripe card.

In some embodiments, a player tracking card reader 144, a transceiver for wireless communication with a player's smartphone, a keypad 146, and/or an illuminated display 148 for reading, receiving, entering, and/or displaying player tracking information is provided in EGM 104A. In such embodiments, a game controller within the gaming device 104A can communicate with the player tracking server system 110 to send and receive player tracking information.

Gaming device 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

There may also be one or more information panels 152 which may be a back-lit, silkscreened glass panel with lettering to indicate general game information including, for example, a game denomination (e.g., $0.25 or $1), pay lines, pay tables, and/or various game related graphics. In some embodiments, the information panel(s) 152 may be implemented as an additional video display.

Gaming devices 104A have traditionally also included a handle 132 typically mounted to the side of main cabinet 116 which may be used to initiate game play.

Figure 2:
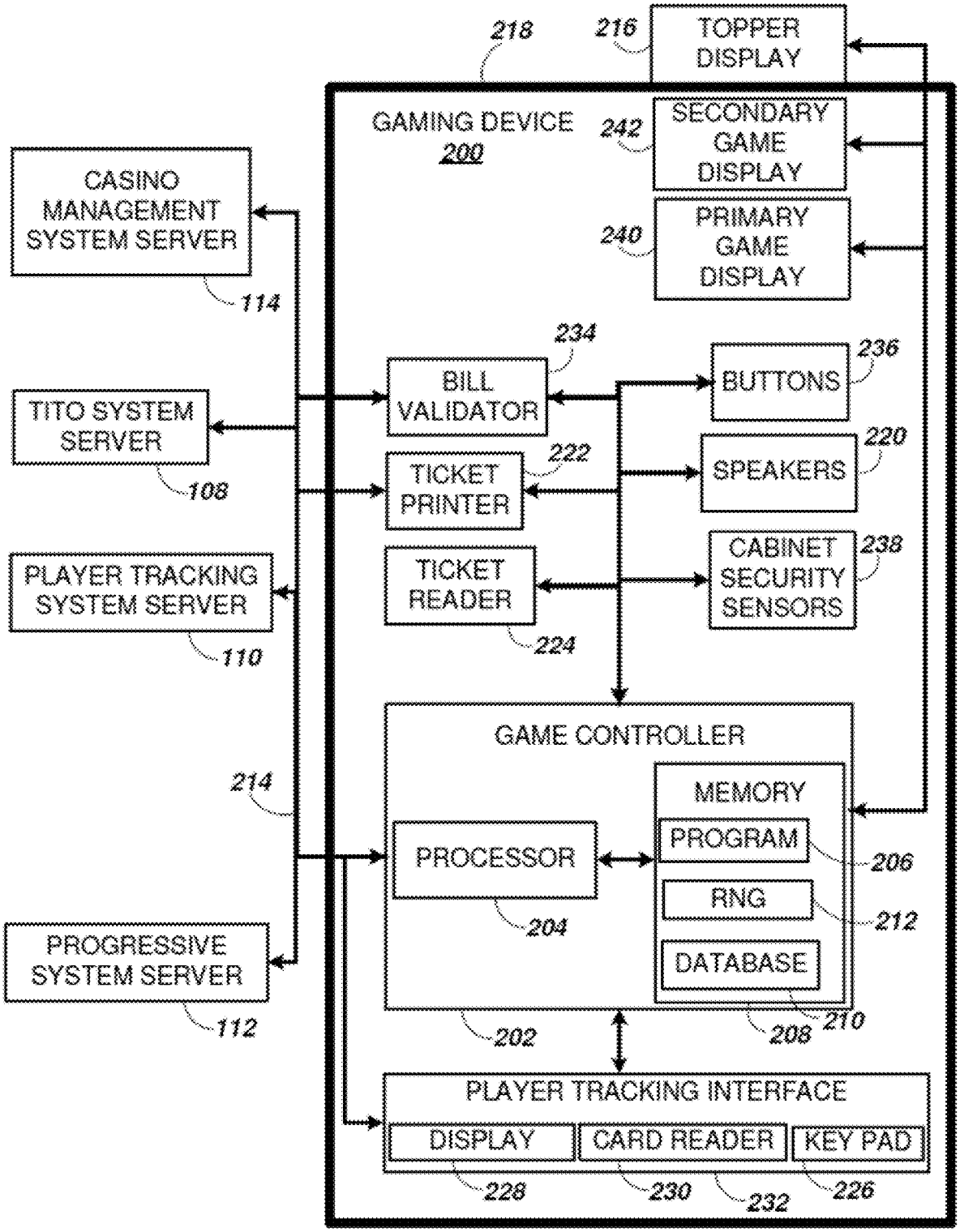
FIG. 2 is a block diagram showing various functional elements of an exemplary EGM.

Many or all the above described components can be controlled by circuitry (e.g., a gaming controller) housed inside the main cabinet 116 of the gaming device 104A, the details of which are shown in FIG. 2.

Note that not all gaming devices suitable for implementing embodiments of the disclosed technology necessarily include top wheels, top boxes, information panels, cashless ticket systems, and/or player tracking systems. Further, some suitable gaming devices have only a single game display that includes only a mechanical set of reels and/or a video display, while others are designed for bar counters or table tops and have displays that face upwards.

An alternative example gaming device 104B illustrated in FIG. 1 is the Arc™ model gaming device manufactured by Aristocrat® Technologies, Inc. Note that where possible, reference numerals identifying similar features of the gaming device 104A embodiment are also identified in the gaming device 104B embodiment using the same reference numbers. Gaming device 104B does not include physical reels and instead shows game play functions on main display 128. An optional topper screen 140 may be used as a secondary game display for bonus play, to show game features or attraction activities while a game is not in play, or any other information or media desired by the game designer or operator. In some embodiments, topper screen 140 may also or alternatively be used to display progressive jackpot prizes available to a player during play of gaming device 104B.

Example gaming device 104B includes a main cabinet 116 including a main door 118 which opens to provide access to the interior of the gaming device 104B. The main or service door 118 is typically used by service personnel to refill the ticket-out printer 126 and collect bills and tickets inserted into the bill validator 124. The door 118 may also be accessed to reset the machine, verify and/or upgrade the software, and for general maintenance operations.

Another example gaming device 104C shown is the Helix™ model gaming device manufactured by Aristocrat® Technologies, Inc. Gaming device 104C includes a main display 128A that is in a landscape orientation. Although not illustrated by the front view provided, the landscape display 128A may have a curvature radius from top to bottom, or alternatively from side to side. In some embodiments, display 128A is a flat panel display. Main display 128A is typically used for primary game play while secondary display 128B is typically used for bonus game play, to show game features or attraction activities while the game is not in play or any other information or media desired by the game designer or operator.

Many different types of games, including mechanical slot games, video slot games, video poker, video black jack, video pachinko, keno, bingo, and lottery, may be provided with or implemented within the depicted gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class 2 or Class 3, etc.

FIG. 2 is a block diagram depicting exemplary internal electronic components of a gaming device 200 connected to various external systems. All or parts of the example gaming device 200 shown could be used to implement any one of the example gaming devices 104A-X depicted in FIG. 1. The games available for play on the gaming device 200 are controlled by a game controller 202 that includes one or more processors 204 and a game that may be stored as game software or a program 206 in a memory 208 coupled to the processor 204. The memory 208 may include one or more mass storage devices or media that are housed within gaming device 200. Within the mass storage devices and/or memory 208, one or more databases 210 may be provided for use by the program 206. A random number generator (RNG) 212 that can be implemented in hardware and/or software is typically used to generate random numbers that are used in the operation of game play to ensure that game play outcomes are random and meet regulations for a game of chance. In some embodiments, the random number generator 212 is a pseudo-random number generator.

Alternatively, a game instance (i.e. a play or round of the game) may be generated on a remote gaming device such as a central determination gaming system server 106 (not shown in FIG. 2 but see FIG. 1). The game instance is communicated to gaming device 200 via the network 214 and then displayed on gaming device 200. Gaming device 200 may execute game software, such as but not limited to video streaming software that allows the game to be displayed on gaming device 200. When a game is stored on gaming device 200, it may be loaded from a memory 208 (e.g., from a read only memory (ROM)) or from the central determination gaming system server 106 to memory 208. The memory 208 may include RAM, ROM or another form of storage media that stores instructions for execution by the processor 204.

The gaming device 200 may include a topper display 216 or another form of a top box (e.g., a topper wheel, a topper screen, etc.) which sits above main cabinet 218. The gaming cabinet 218 or topper display 216 may also house a number of other components which may be used to add features to a game being played on gaming device 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. The player tracking interface 232 may include a keypad 226 for entering information, a player tracking display 228 for displaying information (e.g., an illuminated or video display), a card reader 230 for receiving data and/or communicating information to and from media or a device such as a smart phone enabling player tracking. Ticket printer 222 may be used to print tickets for a TITO system server 108. The gaming device 200 may further include a bill validator 234, buttons 236 for player input, cabinet security sensors 238 to detect unauthorized opening of the cabinet 218, a primary game display 240, and a secondary game display 242, each coupled to and operable under the control of game controller 202.

Gaming device 200 may be connected over network 214 to player tracking system server 110. Player tracking system server 110 may be, for example, an OASIS® system manufactured by Aristocrat® Technologies, Inc. Player tracking system server 110 is used to track play (e.g. amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by a casino management system.

Gaming devices, such as gaming devices 104A-104X, 200, are highly regulated to ensure fairness and, in many cases, gaming devices 104A-104X, 200 are operable to award monetary awards (e.g., typically dispensed in the form of a redeemable voucher). Therefore, to satisfy security and regulatory requirements in a gaming environment, hardware and software architectures are implemented in gaming devices 104A-104X, 200 that differ significantly from those of general-purpose computers. Adapting general purpose computers to function as gaming devices 200 is not simple or straightforward because of: 1) the regulatory requirements for gaming devices 200, 2) the harsh environment in which gaming devices 200 operate, 3) security requirements, 4) fault tolerance requirements, and 5) the requirement for additional special purpose componentry enabling functionality of an EGM. These differences require substantial engineering effort with respect to game design implementation, hardware components and software.

When a player wishes to play the gaming device 200, he/she can insert cash or a ticket voucher through a coin acceptor (not shown) or bill validator 234 to establish a credit balance on the gamine machine. The credit balance is used by the player to place wagers on instances of the game and to receive credit awards based on the outcome of winning instances. The credit balance is decreased by the amount of each wager and increased upon a win. The player can add additional credits to the balance at any time. The player may also optionally insert a loyalty club card into the card reader 230. During the game, the player views the game outcome on the game displays 240, 242. Other game and prize information may also be displayed.

For each game instance, a player may make selections, which may affect play of the game. For example, the player may vary the total amount wagered by selecting the amount bet per line and the number of lines played. In many games, the player is asked to initiate or select options during course of game play (such as spinning a wheel to begin a bonus round or select various items during a feature game). The player may make these selections using the player-input buttons 236, the primary game display 240 which may be a touch screen, or using some other input device which enables a player to input information into the gaming device 200. In some embodiments, a player's selection may apply across a plurality of game instances. For example, if the player is awarded additional game instances in the form of free games, the player's prior selection of the amount bet per line and the number of lines played may apply to the free games. The selections available to a player will vary depending on the embodiment. For example, in some embodiments a number of pay lines may be fixed. In other embodiments, the available selections may include different numbers of ways to win instead of different numbers of pay lines.

During certain game events, the gaming device 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming device 200 or from lights behind the information panel 152 (FIG. 1).

When the player is done, he/she cashes out the credit balance (typically by pressing a cash out button to receive a ticket from the ticket printer 222). The ticket may be "cashed-in" for money or inserted into another machine to establish a credit balance for play.

Figure 3:
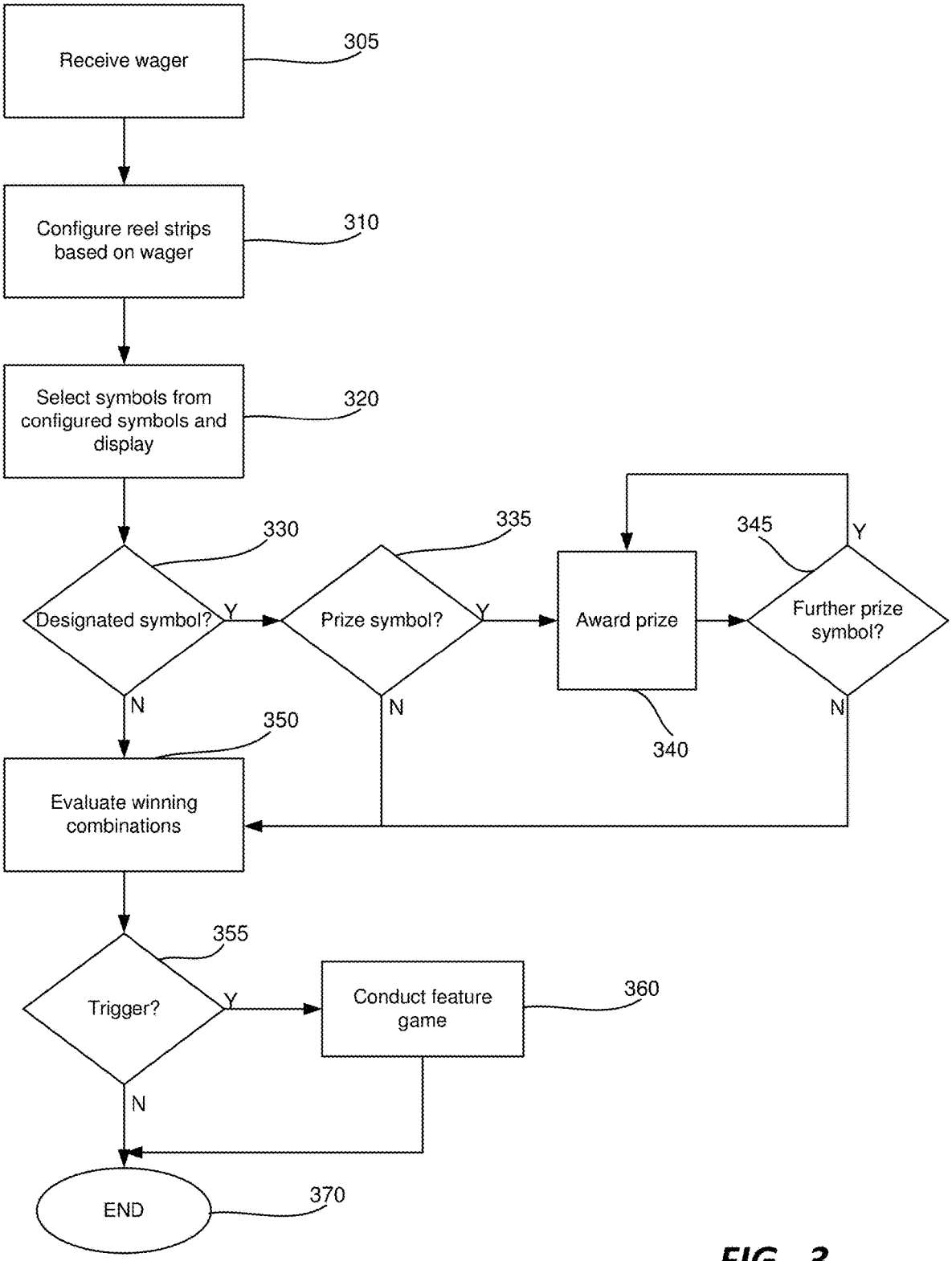
FIG. 3 is a flow chart of a method of operating a gaming device of an embodiment.
Figure 16:
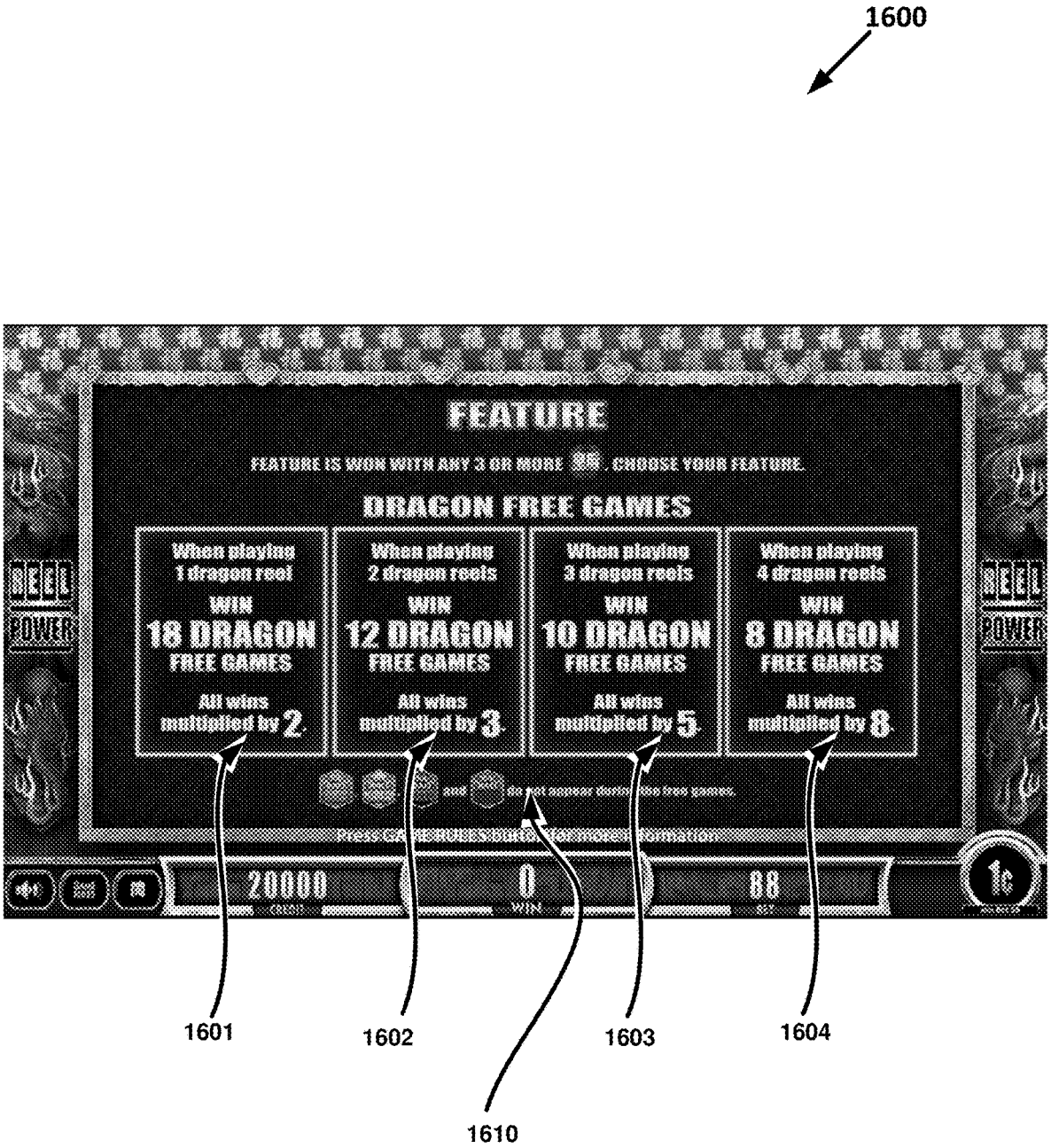
FIG. 16 is an information screen, indicating the effect of selecting a wager in a base game on a feature game.

FIG. 3 is a flow chart of a method 300 of operating a gaming device of an embodiment of the disclosed technology. At step 305, the processor 204 receives a wager responsive to a player making a selection using an input device. FIG. 16 is an example information screen of an embodiment which indicates that part of a user making a wager is to select a number of "Dragon" reels to play, in this example from between 1 and 4 Dragon reels. As will be explained in further detail below, the number of Dragon reels selected, determines the number of reels that the processor 204 will configure with prize symbols. A further one of the reels has a designated symbol which is either a default or a processor 204 selected reel depending on the player wager selection. Prizes corresponding to each selected prize symbol are awarded by the processor 204 when a designated symbol is also selected as explained in further detail below.

Figure 5:
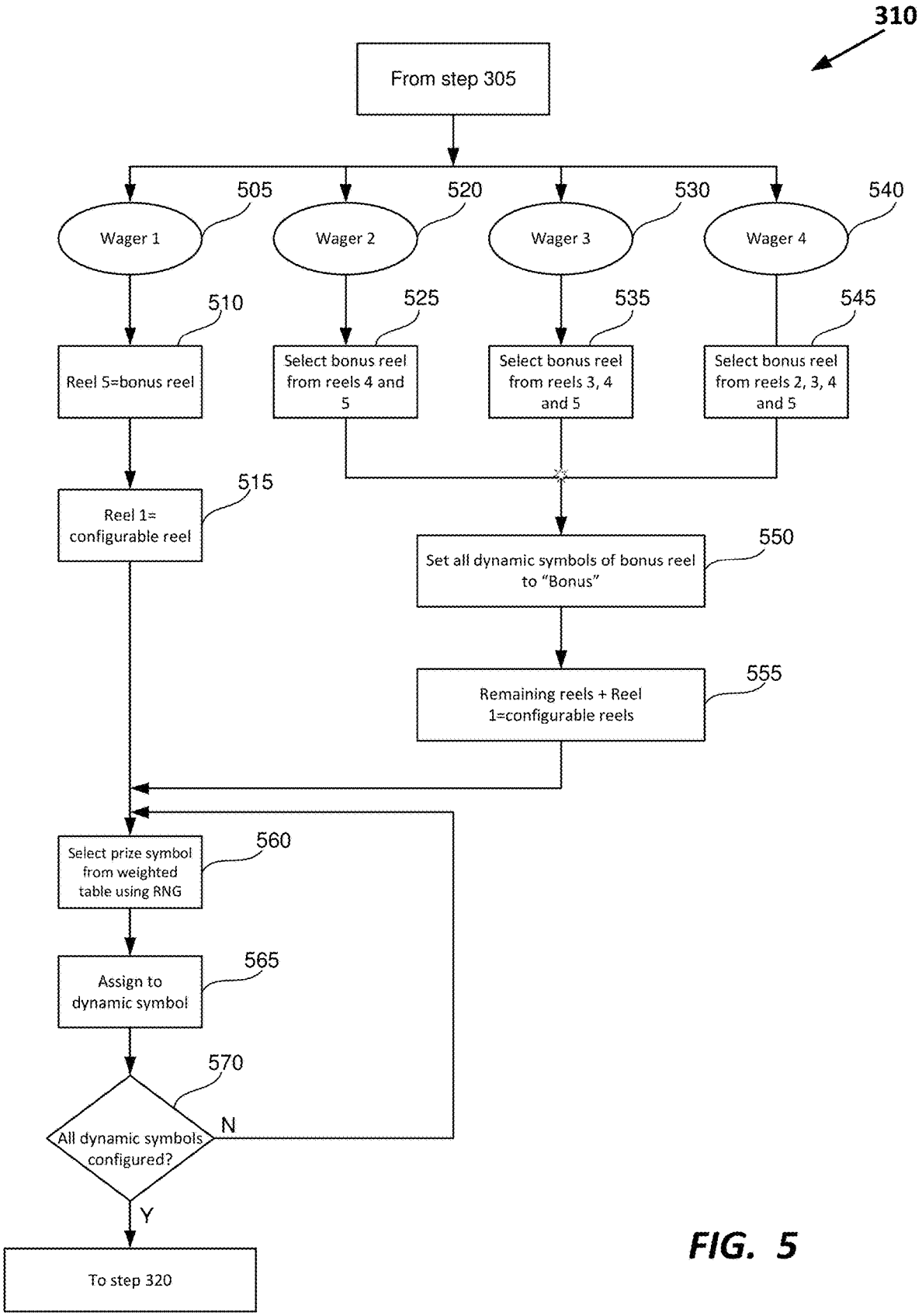
FIG. 5 is a flow chart of a reel configuration method of an embodiment.

At step 310, the processor configures the reel strips (or "reels") as shown in more detail in FIG. 5 below. As shown in FIG. 5, the processor 204 determines a set of steps to implement based on whether the wager is a first wager 505 corresponding to the selection of one Dragon reel, a second wager 520 corresponding to the selection of two Dragon reels, a third wager 530 corresponding to the selection of three Dragon reels, and a fourth wager 540 corresponding to the selection of four Dragon reels. That is, the processor 204 determines a number of reel strips that are to be dynamically, configurable reel strips based on the selection as will be described in further detail below. That is, these reel strips will be configured dynamically for each game instance conducted by the processor 204 for the selected wager.

As shown in FIG. 5 for a first wager (in this example, the wager increase in value from the first to fourth wagers), in this example the processor 204 uses a base or default set of reel set of reel strips where the fifth reel strip (corresponding to a fifth column of symbol positions) is set 510 to have the designated symbol at a number of reel strip positions, in this example a "BONUS" symbol and the first reel strip (corresponding to a first column of symbol positions) is set 515 to be a configurable reel strip. An example default reel strip layout 600 is shown in FIG. 6 in an unconfigured state.

In the example, of FIG. 6 there is a set 600 of five reel strips 641, 642, 643, 644, 645. In the example, each reel strip has thirty reel strip positions 601-630. Each reel strip position of each reel has a symbol. For example, a "Jack" symbol occupies the sixth reel strip position 606 of the fourth reel 644. Other reels strips to those illustrated in FIG. 6 can be used, for example, reel strips where two or more wild symbols are placed at consecutive reel strip positions of a reel strip. In other examples, the reel strips could have between 20 and 100 reel strip positions. The actual length of the reel strips can depend on factors such as the number of wild symbols (in general, the more wilds there are, the longer the reel strip needs to be to maintain the target RTP), and volatility (in general, the higher the prize value is, the longer the reel strip needs to be to lower the hit rate to maintain the target RTP).

As shown in FIG. 6, the fifth reel strip has four instances 651-654 of the designated or "Bonus" symbol at the fourth 604, eleventh 611, fourteenth 614 and twenty-fifth 625 reel strip positions. The first reel strip has five "Dynamic" reel strip positions 661-665 at the second 602, seventh 607, thirteenth 613, twenty-fourth 624 and twenty-fifth 625 reel strip positions. The remaining reel strip positions of the first and fifth reels as well as all the symbols of the second to fourth reel strips 642-644 are occupied by symbols that can result in an award if a sufficient number of them are selected when the reels are evaluated from left to right. In one example, an award can be of a number of free games in response to a defined number of "Scatter" ("Scat") symbols being selected at any of the symbol positions.

In steps 560, 565 and 570, the processor 204 configures one or more (e.g., all) of the dynamic symbols. At step 560, the processor 204 selects one of a plurality of prize symbols based on a weighted table in which each of the possible prize symbols is associated with a probability of the prize symbol being selected. The possible values that can be returned from a true or pseudo random number generator 212 are divided into ranges based on the probabilities associated with each possible prize symbol. The processor 204 obtains a randomly generated number from the RNG 212 and compares it to the ranges to determine which of the prize symbols is selected. The processor 204 then assigns 565 the prize symbols to the dynamic reel strip positions in a defined order, in this example starting with the dynamic reel strip position nearest the, "top", "left most" and of the reel strip layout 600 and working to the "bottom", "right most" dynamic reel strip position. That is at step 570, the processor 204 determines whether all dynamic symbols have been configured and if not returns to step 560 and at step 565 assigns the selected prize symbol to the next dynamic symbol position in this sequence. In the case of FIG. 6, the assignment order is the second 602, seventh 607, thirteenth 613, twenty-third 623 and twenty-fourth 624 reel strip positions of the first reel strip.

FIG. 7 shows a configured reel strip layout 600A where first reel strip is in a configured state 641A. In this state 600A, a JADE prize symbol 661A has been allocated to the second reel strip position 602, a 1688 credits prize symbol 662A has been allocated to the seventh reel strip position 607, an 88 credits prize symbol 663A has been allocated to the thirteenth reel strip position 613, an 888 credits prize symbol 664A has been allocated to the twenty-third reel strip position 623 and a GOLD prize symbol 665A has been allocated to the twenty-fourth 624 reel strip position.

As indicated above, the wager selected by the player affects the number of reels to be configured. If a player selects one of Wager 2 520, Wager 3 530, and Wager 4 540, an additional step is carried out of selecting a reel strip to be configured with the designated symbol. In this example, in each case, the first reel strip 641 is always configured with prize symbols such that the selection is from the remaining reel strips. In the example, where Wager 2 520 is received, the processor 204 selects from fourth and fifth reel strips 644, 645; where Wager 3 530 is received, the processor 204 selects from third, fourth and fifth reel strips 643, 644, 645; and where Wager 4 540 is received, the processor 204 selects from second, third, fourth and fifth reel strips 642, 643, 644, 645. In the example, each reel strip has an equal chance of being selected, accordingly to select a reel processor compares a random number obtained from RNG to ranges of equal size assigned to each selectable reel strip.

At step 550, the processor 204 sets all dynamic symbols of the selected Bonus reel to the designated "Bonus" symbol. An example of this configuration process is shown in FIGS. 8 and 9. (In further embodiments, one or more of the dynamic symbols of the selected Bonus reel are modified to the designated "Bonus" symbol.) FIG. 8 shows the set of reel strips 800 where the player has elected Wager 4 (4 Dragon reels). In this example, there are dynamic reel strip positions 851-872 on each of the reel strips 841-845. FIG. 9 shows an example of a partially configured reel strip layout 800A, where the second reel strip is shown in a configured state 842A—e.g., second reel strip 842 has been selected by processor 204 as the bonus reel and has been configured by processor 204 with Bonus symbols 856A-859A. At step 555, the processor 204 sets the remaining reel strips (here third to fifth reel strips 843-845) and the first reel strip 841 as the reel strips having dynamically configurable symbol positions requiring configuring. The processor 204 then proceeds to steps 560 to 570 to complete configuring the reel strips 841, 843-845 by assigning prize symbols (not shown) to each dynamically configurable symbol position 851-855, 860-872.

It will thus be appreciated that in the example, there are two base game reel strips for each of Reels 2 to 5 stored in memory 208 as reel strip 641 and reel strip 841 are identical.

In alternative examples, processor 204 is configured to replace symbols at certain positions of Reels 842-844 with prize symbols when they are used.

In the example above, the selected wager determines which reel strips will be configurable—e.g., defines a specific set of reels to be configured. In another example, the processor can be configured to conduct a random determination as to which of the reel strips will be configured. Further, in the example, for the first wager the fifth reel is always the reel that has the designated symbol and the first reel is always configured with prize symbols. In alternative examples, the processor 204 can be configured to select from among the first and fifth reels which will have the designated symbol and which will have prize symbols or the processor 204 can be configured to select two reels at random before then selecting one of the them to have the designated symbol and one of them to have the bonus symbol. Similarly, in the above example, the first reel always has prize symbols when two or more Dragon reels are selected. In an alternative example, the processor 204 can be configured to include the first reel in the reels which can be configured with the designated symbol. In another alternative example, a different reel can always have prize symbols. In yet another example, the reel strip that has the bonus symbol can be fixed. Further, while in the above example, all designated symbols are on a single reel strip, in other embodiments, designated symbols may be selected on different reel strips and/or reel strips may have a mixture of designated symbols and prize symbols.

Figure 4:
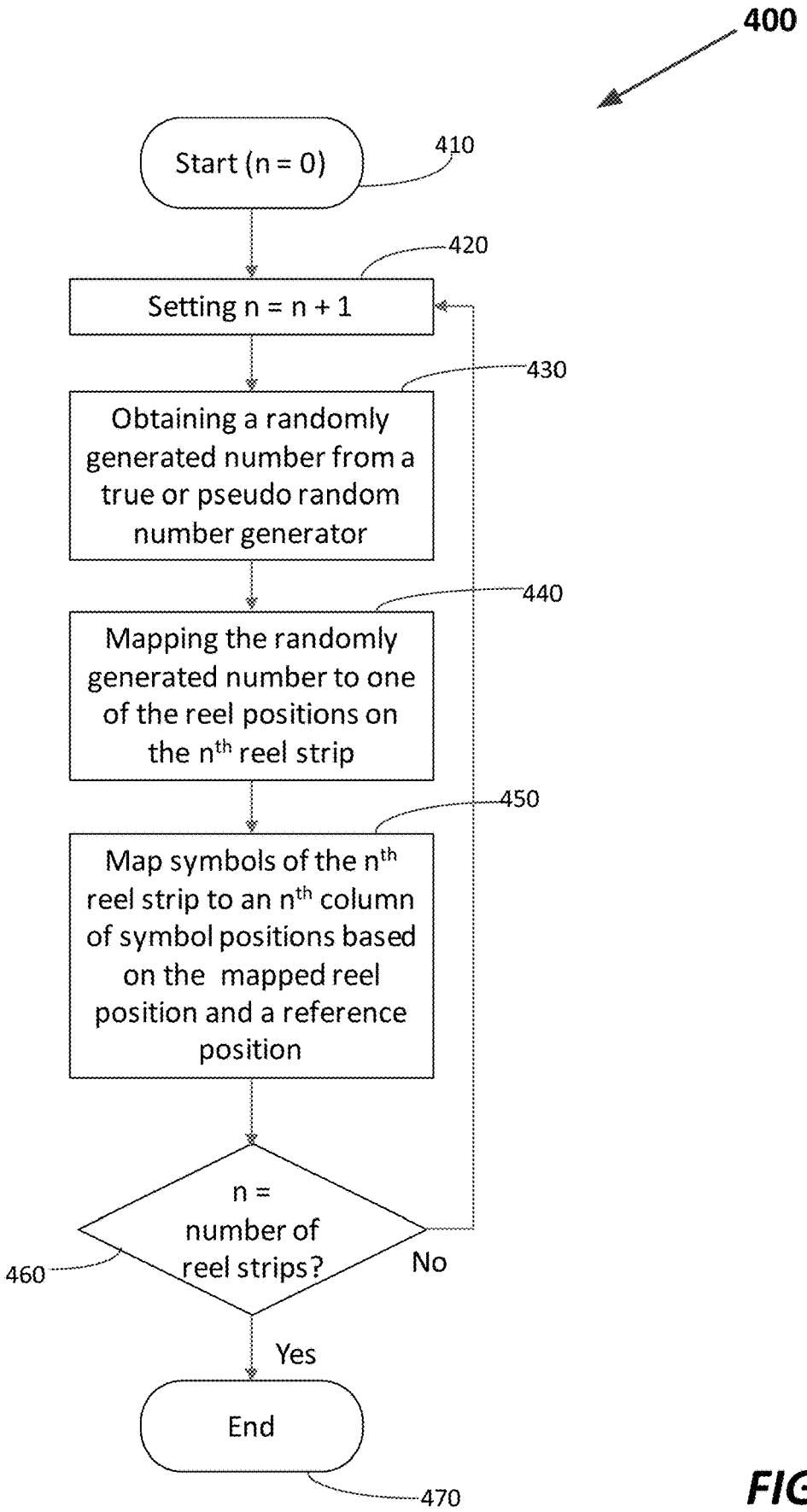
FIG. 4 is a flow chart of a symbol selection method.

Once the reel strips have been configured, the processor selects 320 symbols from the configured reel strips for display. FIG. 4 is a flow chart of a method 400 carried out by the processor 204 to select symbols from reel strips. At step 410, the processor 204 starts the process of selecting symbols with a counter (n) set at zero as symbols have not yet been selected from any reel strips. At step 420, the processor 204 increments the counter. In the first iteration, the counter is set to 1 to reflect that symbols are to be selected from a first reel strip. At step 430 the processor obtains a randomly generated number from a true or pseudo random number generator 212. At step 440 the processor maps the generated number to one of the reel positions of the $n^{th}$ reel strip. In the first iteration, this is the first reel strip. To map the generated number to one of the reel positions, the possible values that can be returned from the RNG 212 are divided into ranges and associated with specific ones of the reel positions in memory 208. In one example, these ranges are stored as a look-up table. In one example, the ranges are each the same size so that each of the reel strip positions has the same chance of been selected. In other examples, the ranges may be arranged to weight the relative chances of selecting specific reel strip positions. The reel strips may be of different lengths.

At step 450, the processor 204 maps symbols of the $n^{th}$ reel strip to and nth column of symbol display positions based on the mapped reel position and a reference position. In an example, the reference position is the bottom position of the symbol positions of each column of symbol positions. In this example, the selected reel position (and hence the symbol at this position) is mapped to the bottom symbol position of the column. In the example, there are two other symbol positions in the column of symbol positions and hence symbols at two neighbouring reel strip positions are also mapped to the symbol positions of the column. Referring to the example configured reel strips of FIG. 7, if the value returned by the RNG 212 is mapped to reel position 613, then for the first reel strip 641, "88 Credits" symbol is mapped to a bottom symbol position, "10" symbol is mapped to a middle symbol position, and "Pic 2" symbol is mapped to a top symbol position.

At step 460, the processor 460 determines whether symbols have been selected for all of the reel strips, and if not the processor reverts to step 420 and iterates through steps 430, 440 and 450 until it is determined at step 460 that symbols have been selected from all n reel strips (in this case 5) and mapped to all n columns of symbol positions (again, 5) after which the symbol selection process ends 470. In other examples, different numbers of symbols may be mapped to different numbers of symbol positions.

After the symbols of all reel strips have been mapped to symbol positions, the processor 204 controls display 240 to display them at the symbol positions.

At step 330, the processor 204 begins an evaluation of the selected symbols by determining whether any of the selected symbols are the designated symbol, in this example the bonus symbol. If there is a designated symbol, the processor 204 proceeds to step 335 of determining whether there is a prize symbol. If there is a prize symbol, the processor 204 proceeds to step 340 and awards the prize value shown on the prize symbol. For example, if the prize symbol were an 88 credit symbol 663A as shown in FIG. 7, the processor 204 awards 88 credits by adding 88 credits to a win meter stored in memory 208. At step 345, the processor 204 determines whether there is a further prize symbol and if so, proceeds to award the prize associated with that prize symbol. If at step 335 there is no prize symbol, or at step 345 there is no further prize symbol, the processor 204 proceeds to step 350 and evaluates the winning combinations based on a pay table stored in memory 208. The pay table defines numbers of specific ones of the symbols on the reel strips which will result in an award.

In an example, the evaluation applied is a "Reel Power" evaluation which is a proprietary evaluation of Aristocrat Technologies Australia Pty Ltd. Such evaluations are also known as "ways to win" evaluations. In the example, all winning combinations, all symbols of a reel can form a winning combination of all symbols of every other reel when they are evaluated from left to right such as that there are in this case 243 possible combinations of symbol positions that will result in an award. Each winning combination identified by the processor 204 is awarded by being added to the win meter in memory 208.

At step 355, the processor 204 determines whether there is a trigger condition met in respect of the current play of the game, and if a trigger condition is met, the processor, at step 360, conducts a feature game before the game ends at step 370 and the player is required to place a further wager in order to initiate a further play of the game.

In an example embodiment there are two feature games associated with different trigger conditions such that the feature game conducted at step 360 depends on which trigger condition is met. In one example, a trigger is the occurrence of three or more scatter ("Scat") symbols at any position within the five columns of symbol positions. Another trigger condition is a random chance of triggering a feature based on the appearance of a wild symbol in the set of symbol positions as described in further detail below.

Figure 10:
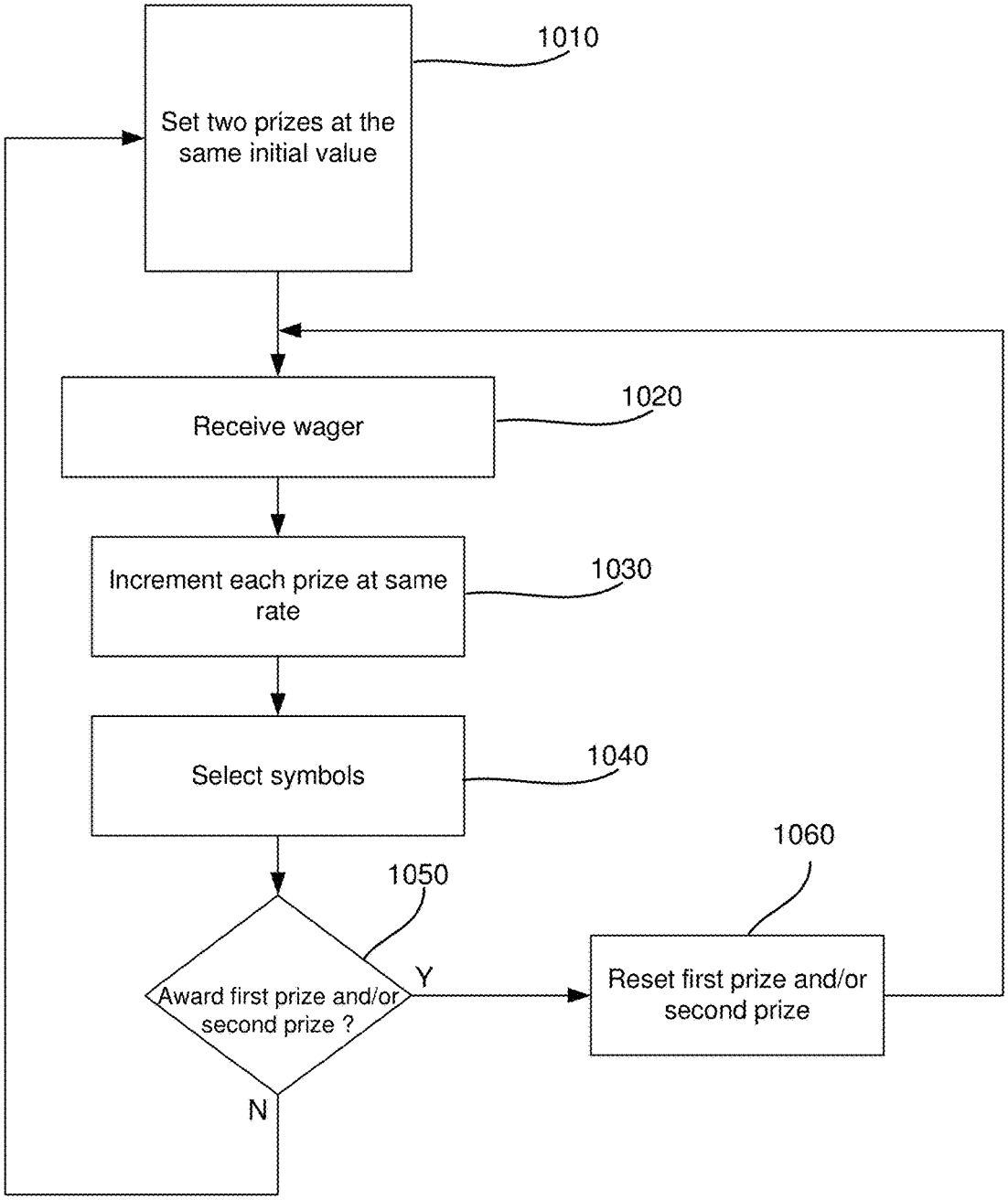
FIG. 10 is a flow chart of a prize increment process.

FIG. 10 illustrates a further aspect of an embodiment of the disclosed technology which occurs over a number of plays of the gaming device 200. The flowchart 1000 of FIG. 10 illustrates how prizes associated with certain allocatable prize symbols are incremented.

Figure 11:
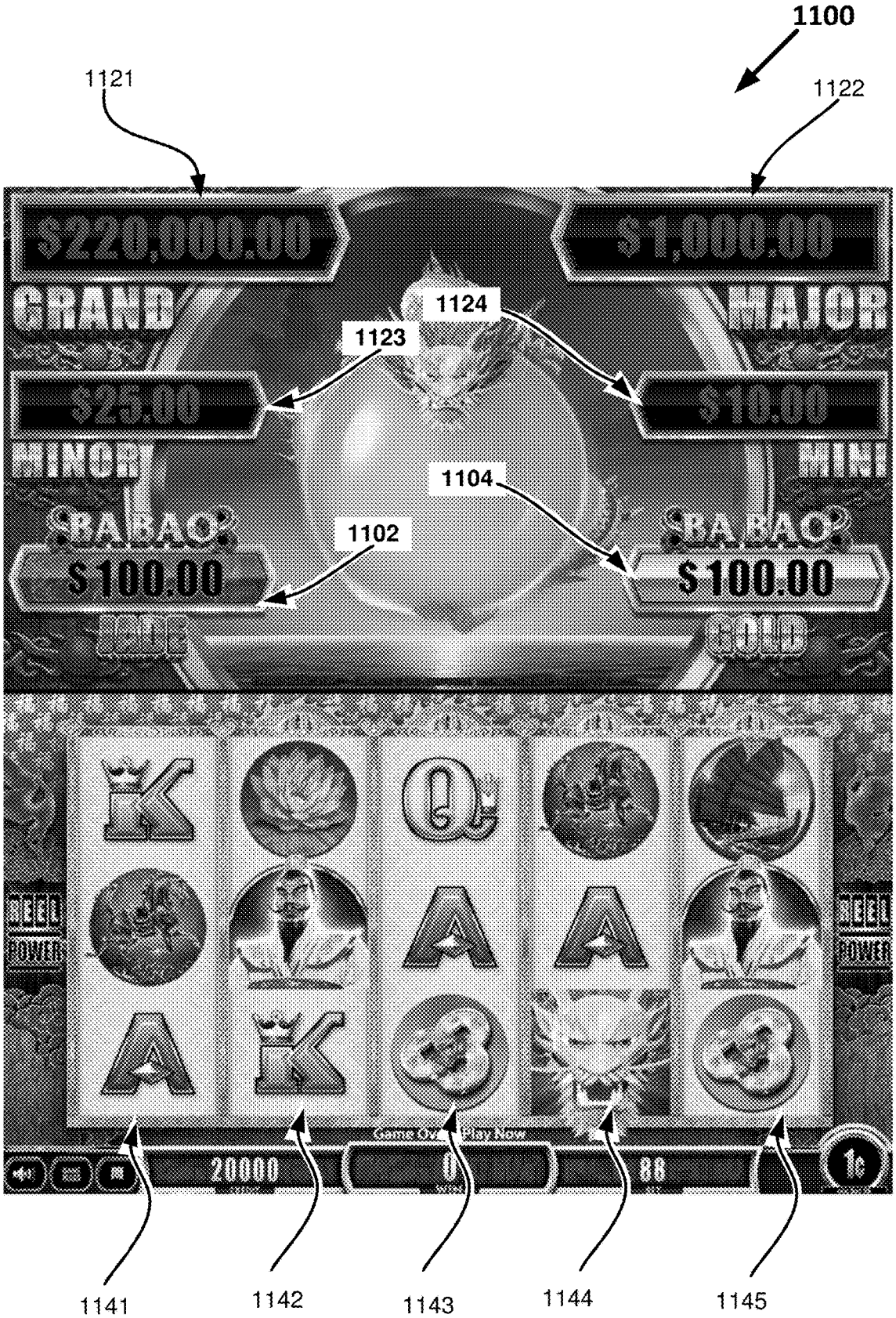
FIGS. 11 to 14 are example screen displays.

At step 1010 the processor 204 sets two prizes to a same initial value, for example when the gaming device 200 is initialised. An example is shown in the example screen display 1100 of FIG. 11. It will be apparent from the example screen display 1100 that there are five columns of symbol positions 1141-1145 each having three symbol positions and above the symbol positions are a number of prize indicators 1121-1124 indicating current values of certain prizes including the value of a grand prize 1121, a major prize 1122, a minor prize 1123 and a mini prize 1124. In addition, there are two further progressive prizes designated as the "JADE" prize 1102 and the "GOLD" prize 1104. From FIG. 11 it will be observed that these prizes are both set as an initial value of $100. These prizes are associated with prize symbols that can be allocated to configurable reel strip positions. In this respect, FIG. 7 shows that, in one example of the reel strips being configured, a JADE prize symbol 661A and a GOLD prize symbol 665A have been allocated to the first reel strip 641A. These progressive prizes 1102, 1004 can advantageously be awarded directly from the occurrence of a single symbol on the reel strip in conjunction with the designated symbol.

In this respect, at step 1020, processor 204 receives a wager in response to a player making a selection.

At step 1030, the processor 204 increments each of the two prizes (here the JADE and GOLD prizes) at a same rate before selecting symbols for display at step 1040 using the method described in relation to FIG. 4 above. An example of a set of selected symbols is shown in the columns 1141-1145 in FIGS. 12 and 13.

Figure 12:
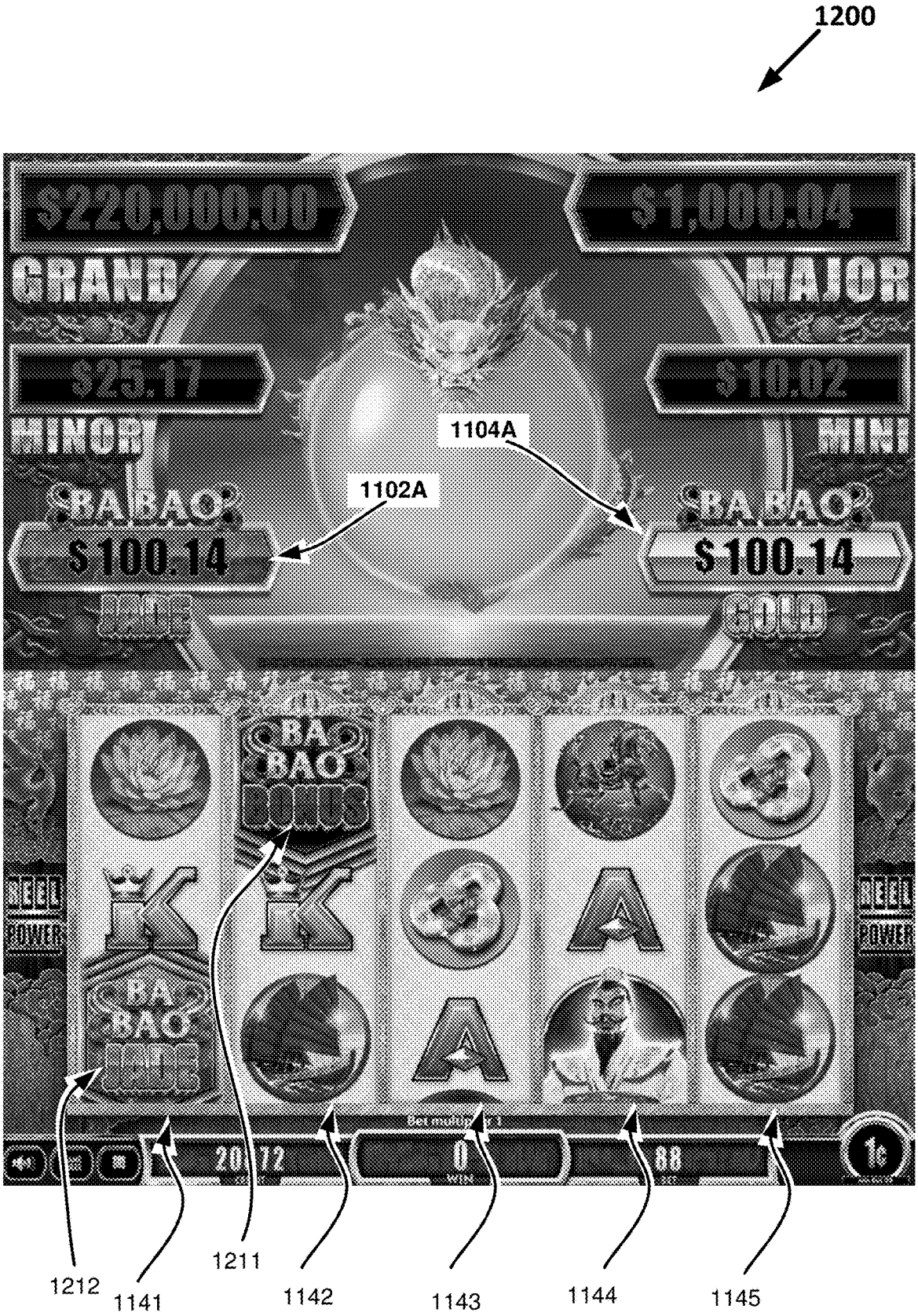
Figure 13:
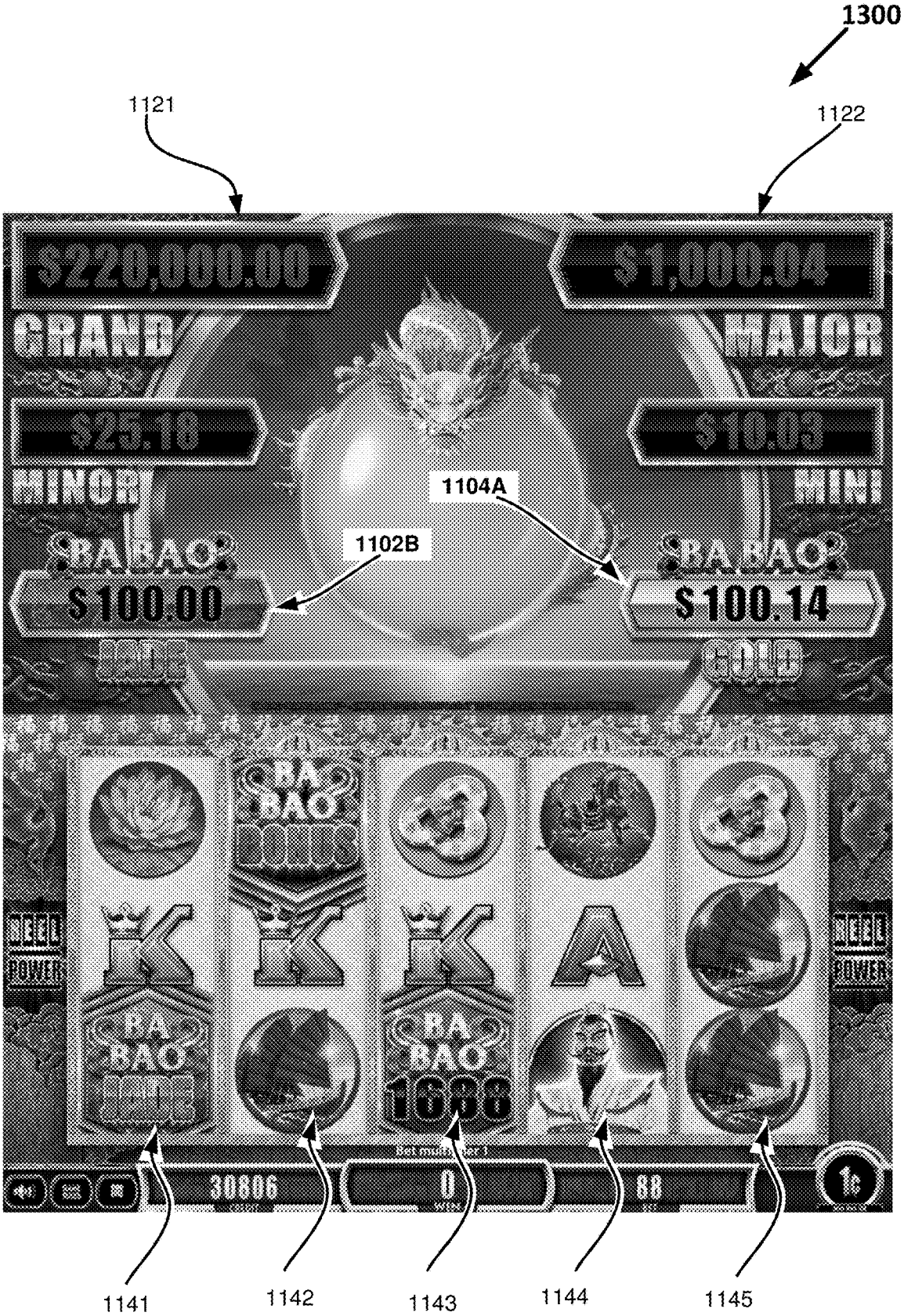

Referring to FIG. 12 there is shown a further example screen display 1200, from which it will be apparent that both the JADE 1102A and GOLD prizes 1104A have been updated to a new value of $100.14. Screen display 1200 also shows a further set of selected symbols which includes a JADE symbol 1212 and a bonus symbol 1211. In the example, these values of increments are relatively low, and it is more likely, in practice, that the prize values of the JADE and GOLD jackpot will have incremented more significantly before one of the prizes is awarded.

At step 1050, the processor 204 determines whether to award the first prize and, in this example case, because the JADE symbol 1212 has been selected in conjunction with the bonus symbol 1211, the processor 204 will make an award of the JADE prize at step 1050. Accordingly, the processor 204 proceeds to step 1060 and resets the prize as shown in the example screen display 1300 of FIG. 13 where the JADE prize has been reset to an initial status 1102B of $100 and the GOLD prize 1104A remains at the same of $100.14.

As shown in FIG. 10 concurrently with awarding the first prize the processor 204 determines whether to award the second prize and such that if it is awarded it can be reset. It is reset at step 1060. It will also be observed that it is possible, though probabilistically less likely, for both prizes to be awarded. After step 1060, the processor 204 reverts to step 1020 such that the processor 204 will continue to increment both prizes at a same rate in response to the receipt of subsequent wagers. It is probabilistically more likely for the prizes to be awarded non-concurrently. In such a case, it is possible that the resetting the two prizes to a same initial value and incrementing the two prizes at the same rate results in a pendulum effect, where an award and reset of a first prize maintains the incremented value of the second prize, which upon award and reset maintains the re-incremented value of the first prize, which again can be awarded and reset, and so on. A skilled person would appreciate that while the pendulum effect is most balanced where the two prizes is set and reset to an identical initial value and incremented at an identical rate, the initial value and incremental rate may be non-identical for an off-balanced pendulum effect.

Figure 14:
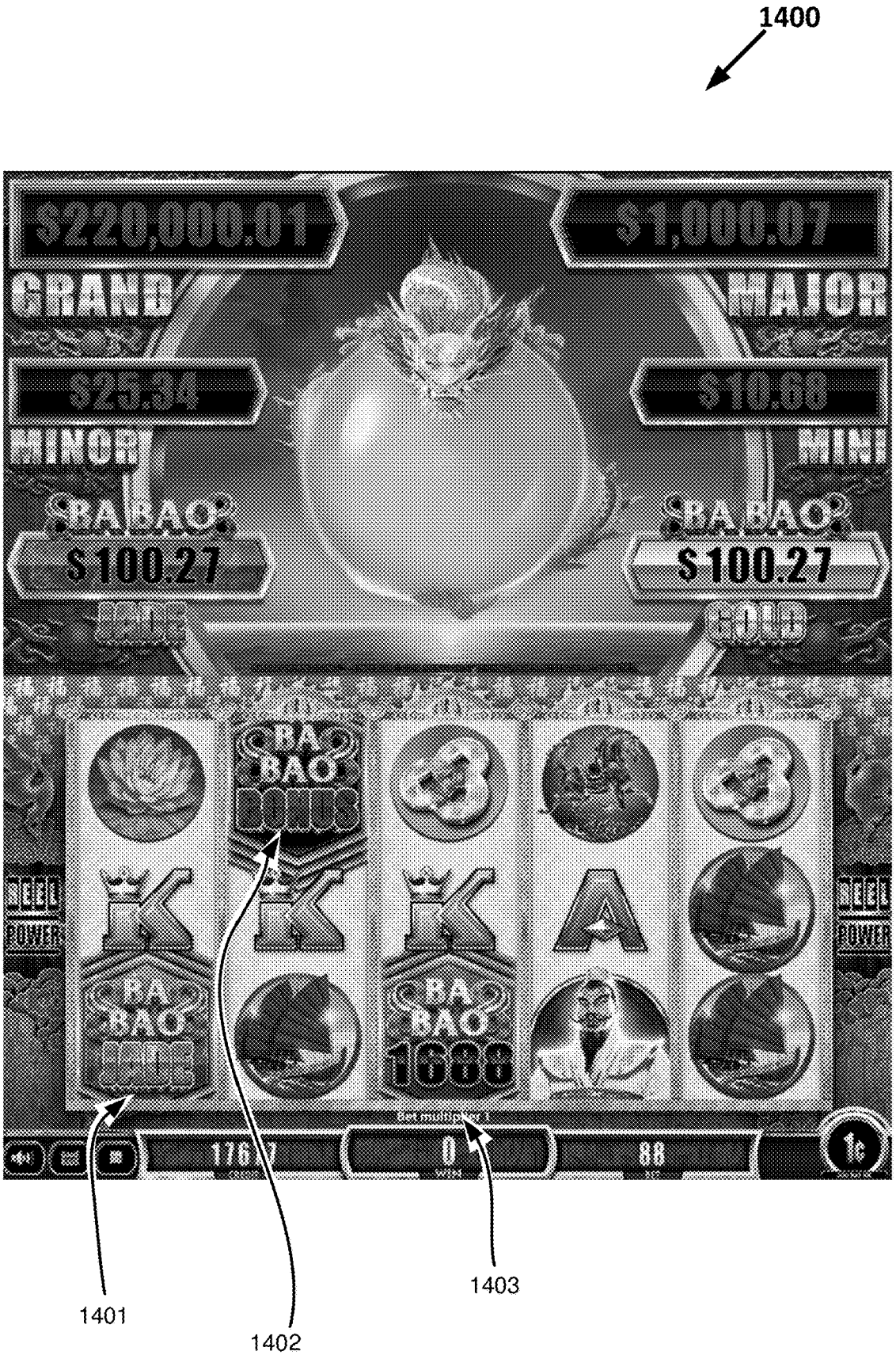

An advantage of making prize awards conditional of display of the designated symbol is that more than one prize can be awarded concurrently. FIG. 14 is an example screen display 1400 where more than one prize would be awarded by virtue of processor 204 carrying out steps 330-345 of FIG. 3. That is, in this case, the bonus symbol 1402 has been selected and the processor 204 will award both the prize associated with the JADE symbol 1401 and the 1688 credit prize corresponding to 1688 credit symbol 1403.

Figure 15:
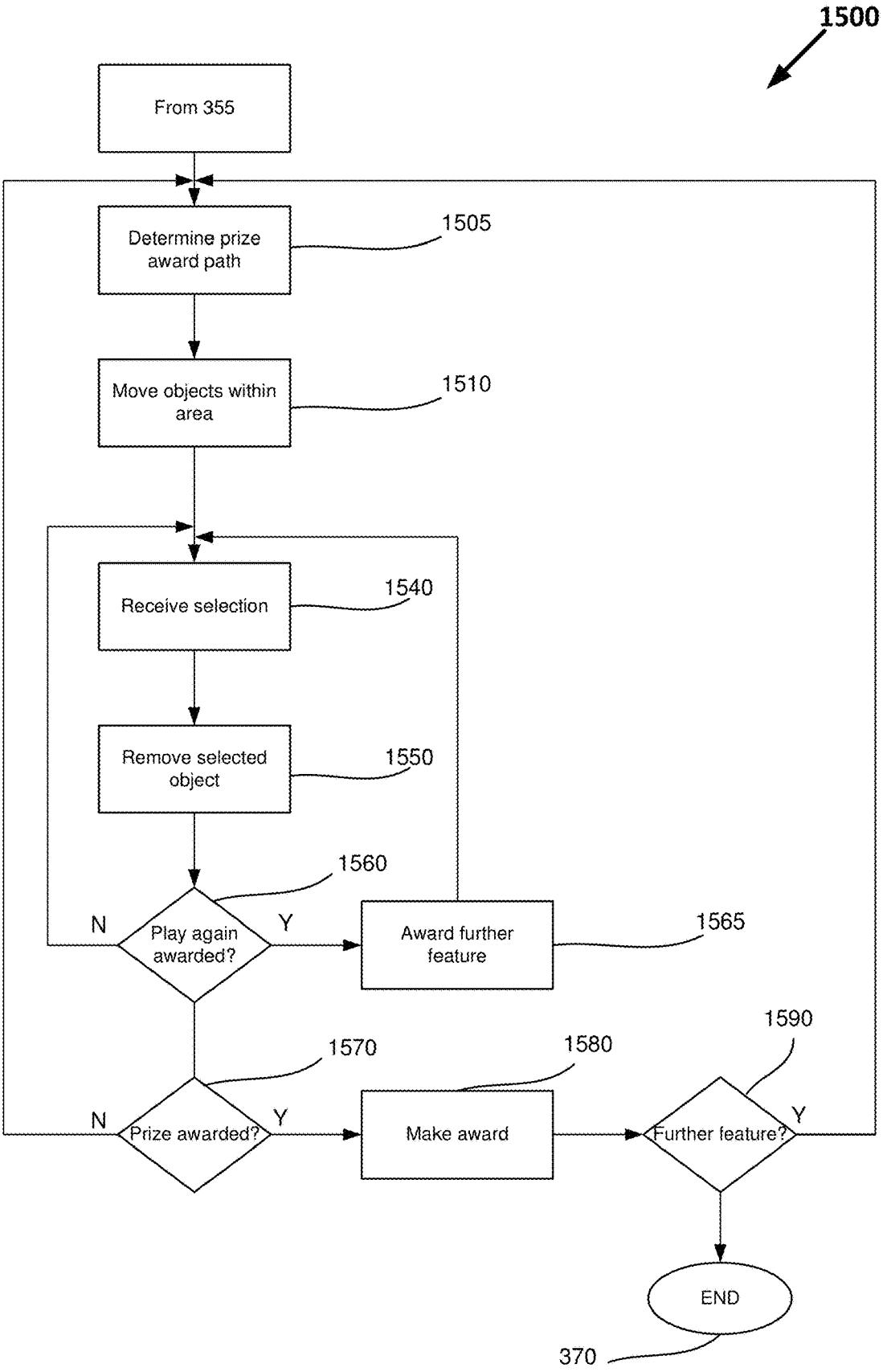
FIG. 15 is a flow chart of a feature game with a moving object prize award process.

FIG. 15 illustrates a feature game of an embodiment of the disclosed technology where a player can be awarded a prize based on turnover since the prize was last awarded. In this example, the trigger condition that is tested is a random trigger condition based on the appearance of a wild symbol on the reels. This trigger condition is tested for each occurrence of a wild symbol (e.g., twice if two wild symbols are selected). The probability of the feature game triggering is hence related to both the probability of a wild symbol being selected which is affected by the number of wild symbols on the reel strips and the probability assigned to evaluating each occurrence of a wild symbol.

Figure 18:
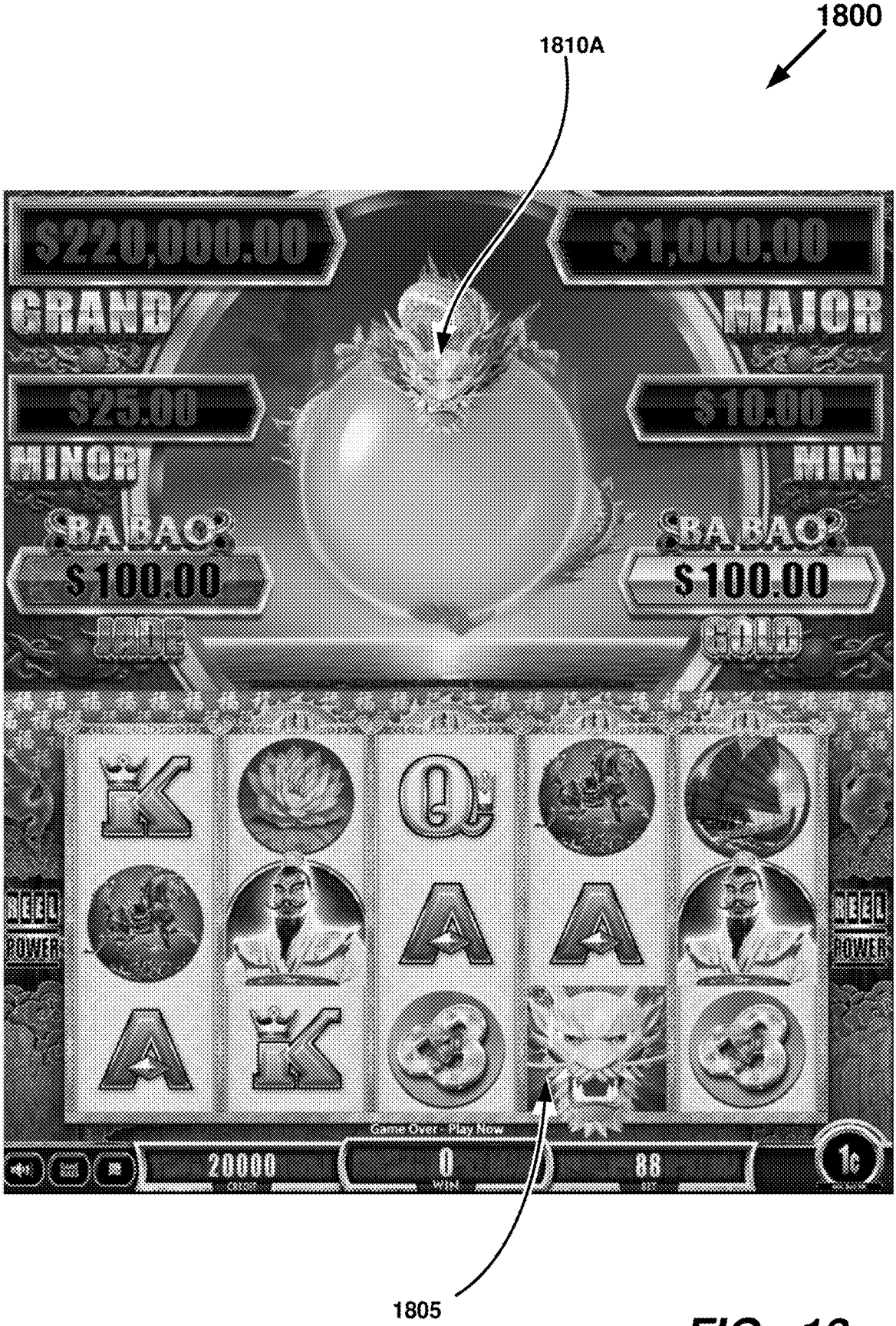
FIGS. 18 to 25 are example screen displays.

FIGS. 18 to 21 illustrate how turnover since a last feature trigger is indicated to a player. In a top portion of the example screen 1800 of FIG. 18 there is shown an animation of a Dragon around a pearl in a first state 1810A of a first size. Also shown in FIG. 18 is an example of the wild symbol 1805. As explained above, each time a wild symbol lands, it triggers a chance of a feature game triggering. In one example, the first state 1810A shown in FIG. 18 corresponds to a turnover in credits since the last award of the feature game of 0 to 7499 credits.

Figure 19:
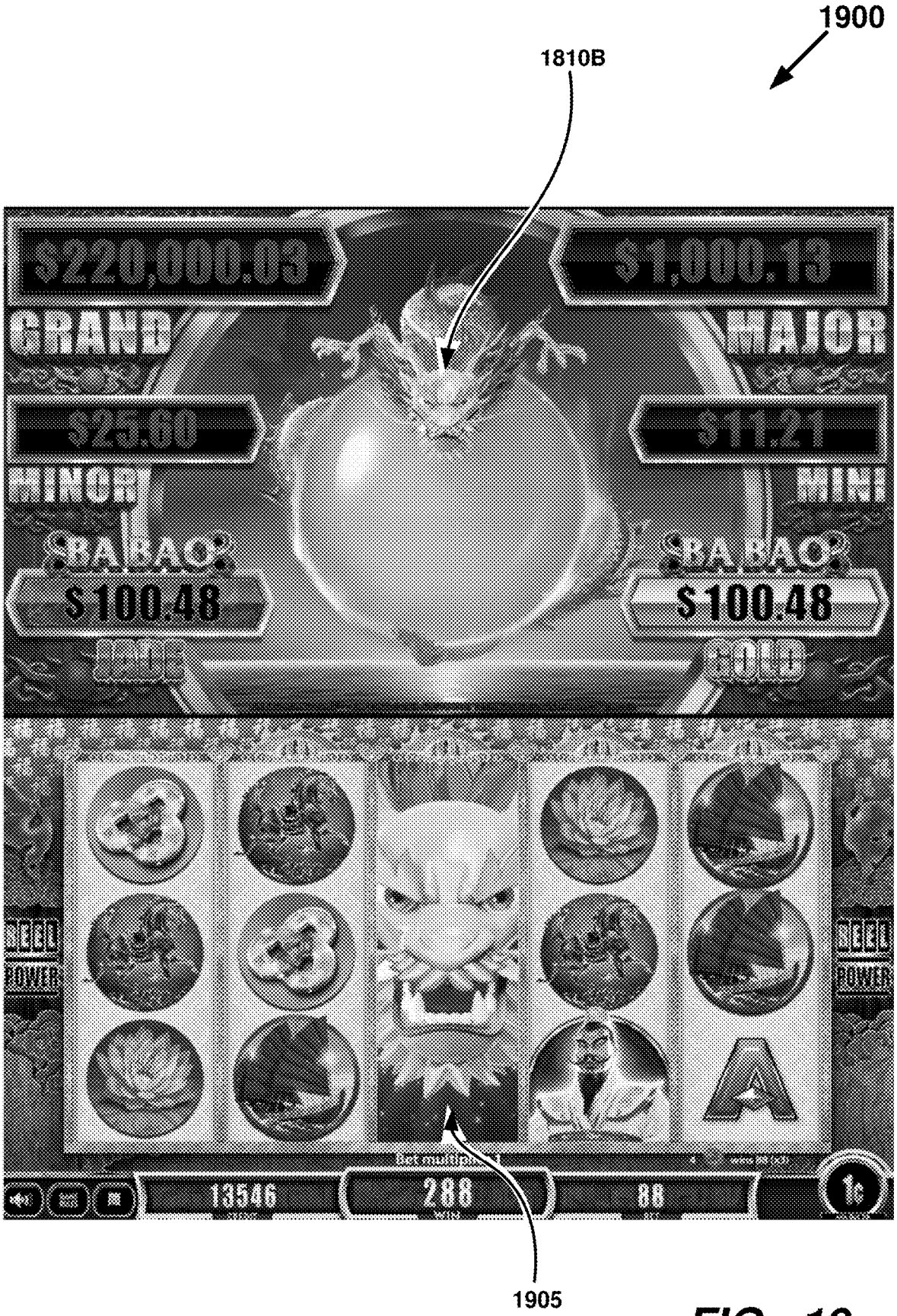

A second state of the turnover indicator 1810B is shown in the screenshot 1900 of FIG. 19. It will be apparent by comparing FIGS. 19 and 18 that the size of the Dragon has increased relative to the pearl. In an example, the second state of FIG. 19 corresponds to a value between 7,500 and 14,999 credits since the last feature trigger.

FIG. 19 also illustrates that when a wild symbol lands on a Dragon reel it is expanded to fill all symbol positions on that reel as shown by expanded wild symbol 1905 in FIG. 19.

Figure 20:
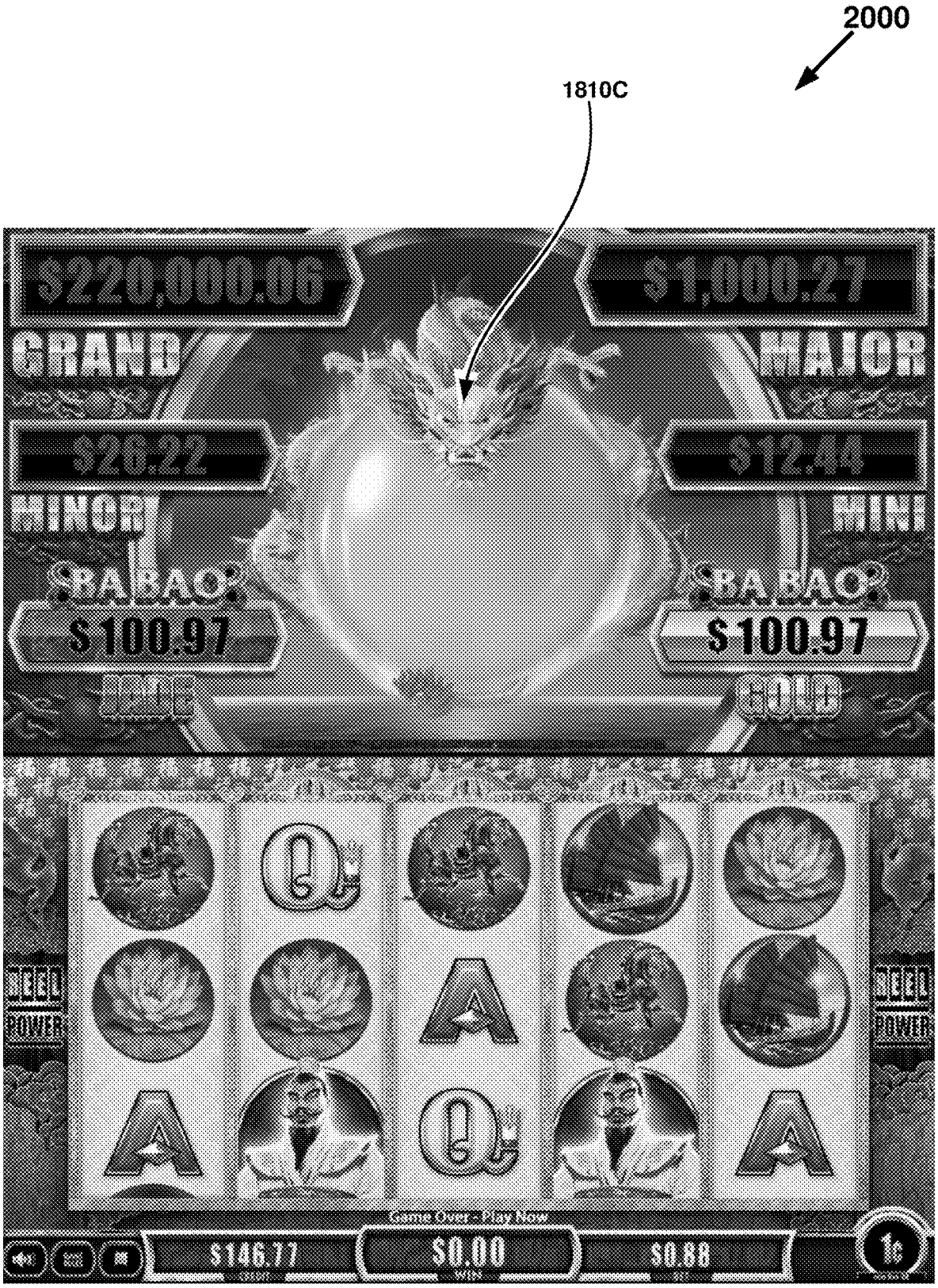

FIG. 20 is an example screen display 2000 showing a third turnover indicator state 1810C. Again, from a comparison with FIGS. 19 and 18, it will be apparent that the Dragon has grown further relative to the pearl. The third state of FIG. 20 corresponds to a turnover of between 15,000 credits and 22,499 credits in an example.

Figure 21:
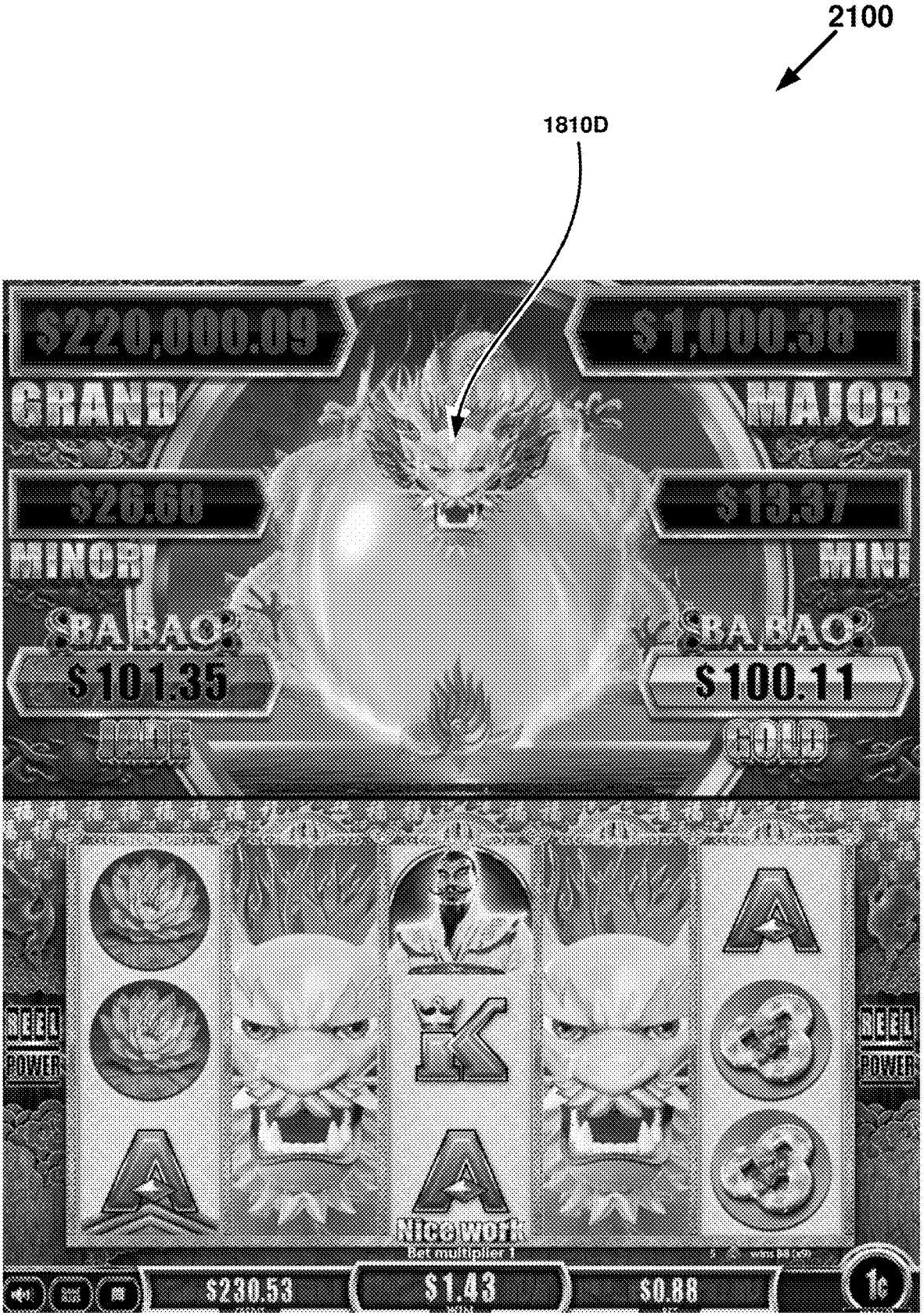

FIG. 21 illustrates a fourth state 1810D where again by comparing with FIGS. 18 to 20, it will apparent that the Dragon has grown further in size relative to the pearl. In an example, this state 1810D corresponds to a credit turnover of 22,500 credits or greater since the last award of a feature game.

Figure 22:
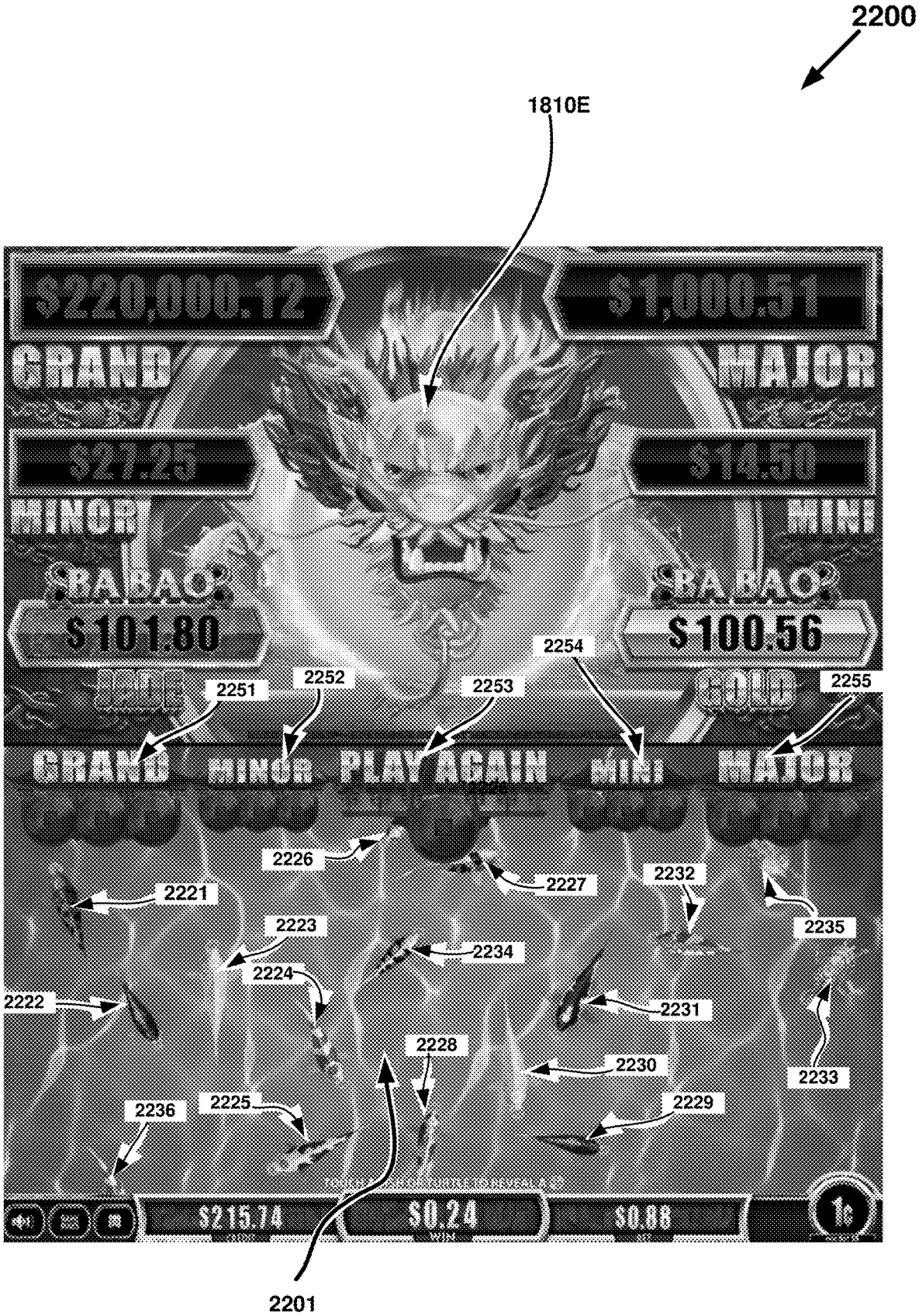

FIG. 22 is a further screen display 2200 showing an award state 1810E of the award indicator that is displayed in response to the feature triggering. Again, it will be apparent that the award indicator 1810E is much larger than that displayed in FIGS. 18 to 21.

Also apparent from FIG. 22 is that the processor 204 has controlled the display 240 such that a moving object display area 2201 has replaced the display of the reels. Moving object display area 2201 is in this example illustrated by moving objects in the form of a plurality of fish and turtles 2221-2236.

As will be illustrated in further detail below, the moving objects 2221-2236 move within display area 2201 and a player touches the objects as part of an award process.

In one example, the processor 204 controls the objects to move within the area 2201 at step 1510.

At step 1510, the processor 204 displays the moving objects based on a number of pre-determined trajectories stored in memory 208. In the example shown in FIG. 22, there are 18 pre-determined trajectories. Each pre-determined trajectory begins and ends at the same boundary or different boundaries of the area 2201 to simulate the entry and exit of the moving objects in the area 2201. In one example, the trajectories are based on one or more curved paths, with or without straight paths, to simulate a swim trajectory.

In an example, before displaying the moving objects, the processor 204 determines an initial number of trajectories to be displayed. For example between 11 and 14 of the 18 trajectories. The processor 204 then a random object for each trajectory (e.g. fish or turtle) and a random place along the trajectory for the object to start.

After the objects start moving, the processor 204 determines at random, from among the remaining 4 to 7 trajectories using a weight table, which trajectory will be used as the next trajectory. The processor also chooses an interval (e.g. every 2 to 8 seconds, again chosen based on a weight table) at which a new object will be introduced to start moving along the next trajectory and a random object (e.g. fish or turtle).

The intervals and rate of movement of the objects are chosen such that there is a fluctuating number of objects visibly moving within the defined area 2201 and is controlled so that the number of objects varies within a desired range. In some examples, the maximum number of trajectories is capped so that the processor 204 will inhibit the selection of a further trajectory if a maximum number of trajectories relative to the number of trajectories that have been selected are active within the defined area 2201 and similarly if the number reaches a minimum number the processor 204 selects a new trajectory. In one example, the minimum and maximum number of objects in the defined area 2201 are set by setting minimum and maximum numbers of unselected trajectories (here 4 and 7 respectively).

Figure 23:
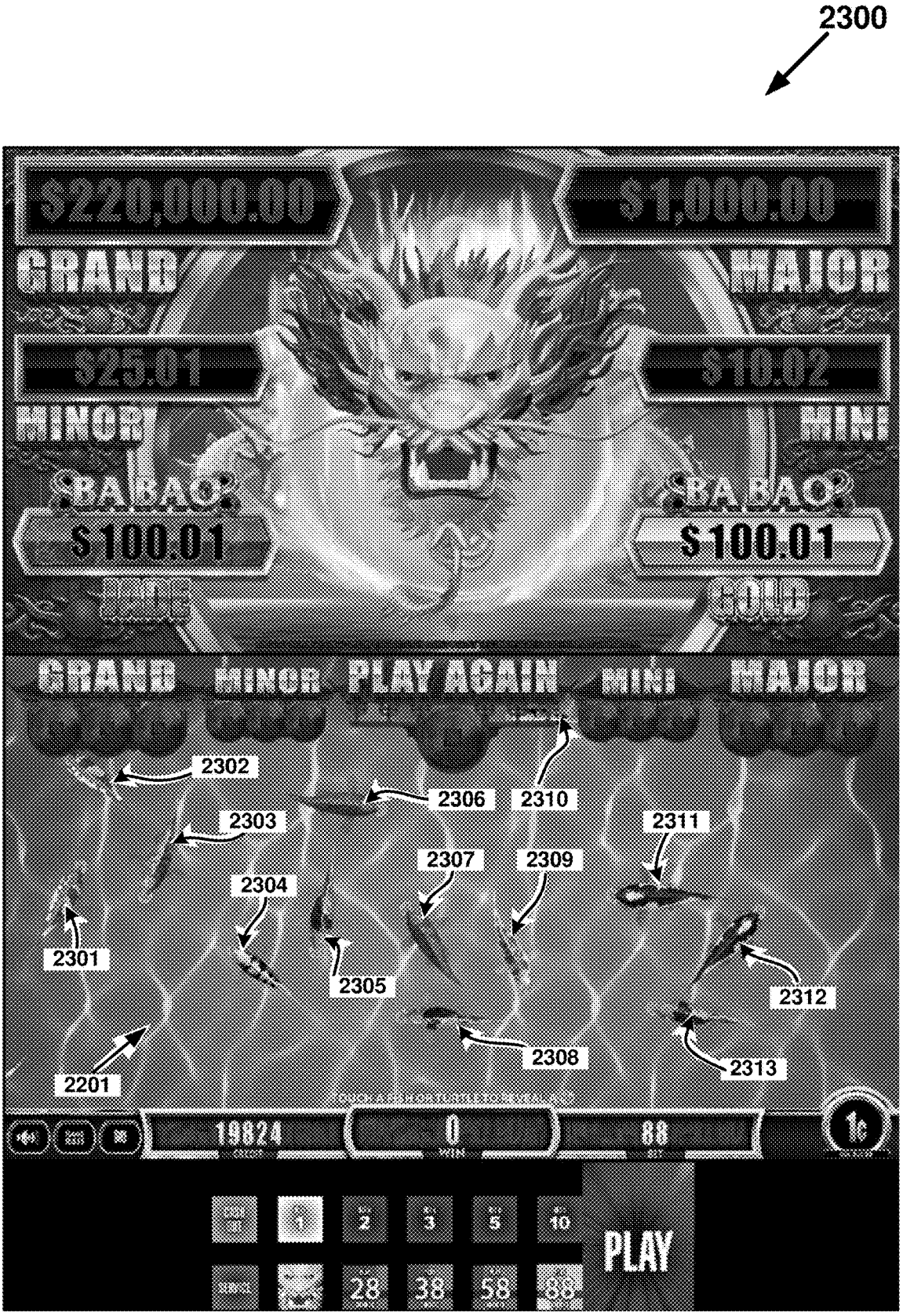
Figure 24:
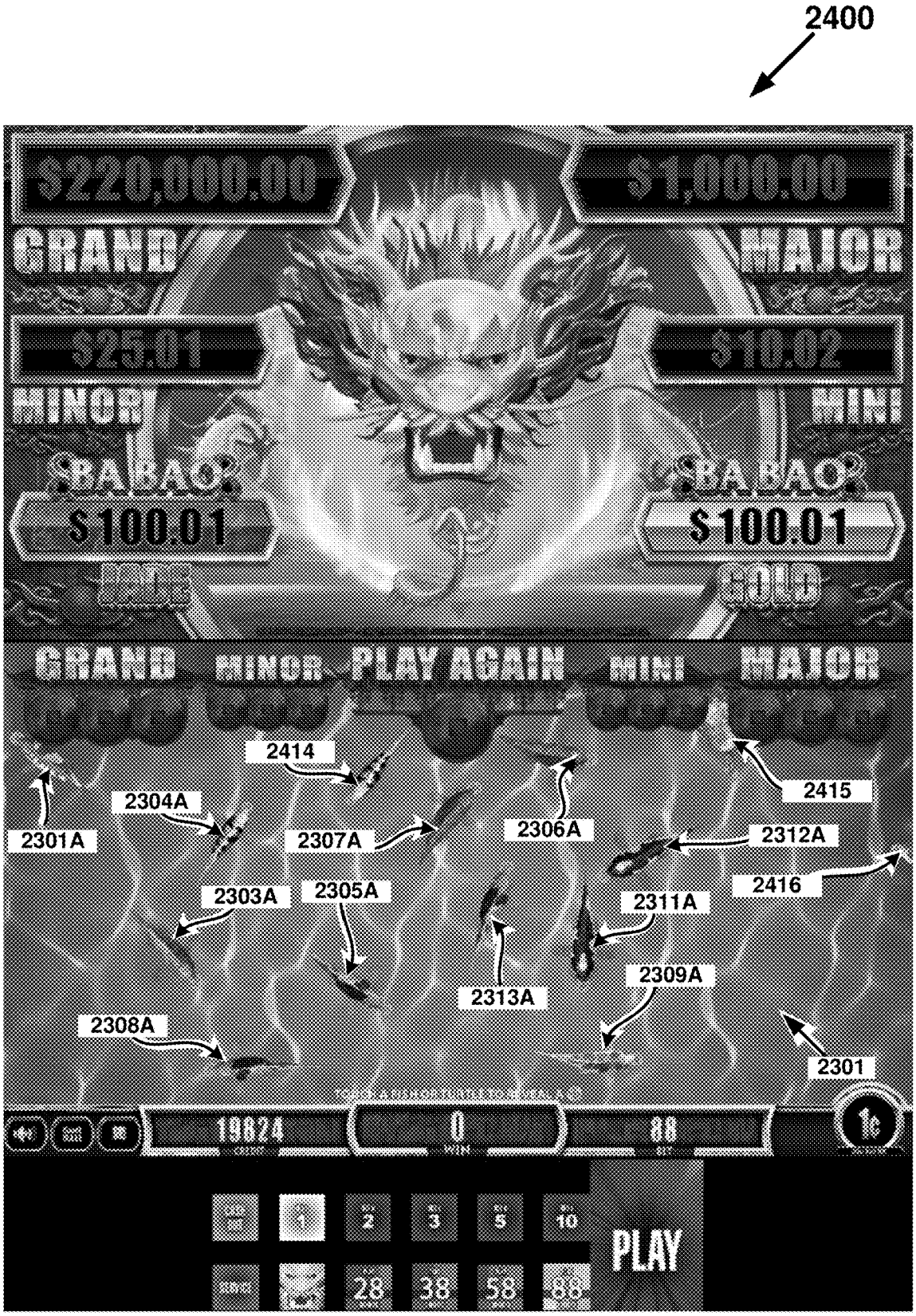

For example, referring to FIGS. 23 and 24 there is shown an example of how objects move in a case where a selection has yet to be made by the player. FIG. 23 is an example screen display 2300 having thirteen moving objects 2301-2313 moving along thirteen trajectories. FIG. 24 is a further example screen display 2400 several seconds later. Moving objects 2301, 2303, 2304, 2305, 2306, 2307, 2308, 2309, 2311, 2312, 2313, 2315 have moved within defined area 2201 to new positions 2301A, 2303A, 2304A, 2305A, 2306A, 2307A, 2308A, 2309A, 2311A, 2312A, 2313A, 2315A. Additional objects 2414,2415,2416 have been added to the defined area 2201 and have begun to move along their respective trajectories so that there are now fourteen objects in total. Objects 2302 and 2314 have followed their trajectories out of the defined area 2201 and are no longer displayed.

Figure 25:
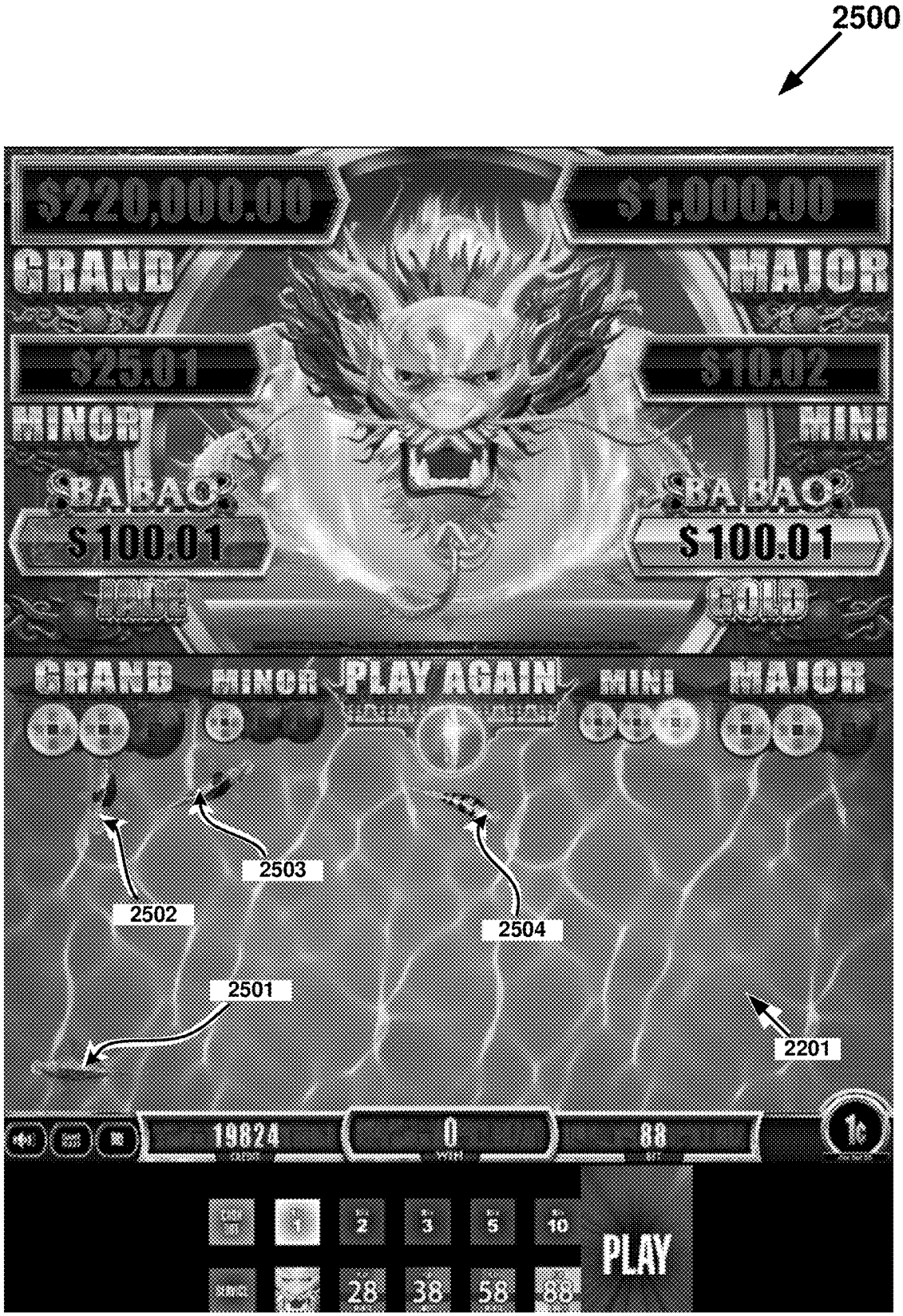

FIG. 25 is a further example screen display after a player has made nine selections. At this time, the player can make a maximum of two further selections and four moving objects 2501-2504 are shown within defined area as moving along their respective trajectories. As nine selections have been made and four objects are shown, the processor 204 currently has available five trajectories which can be selected from to add one or more further moving objects to the defined area.

The variation in the number of moving objects, in conjunction with their simulated entry and exit, adds both time and movement dimensions relative to existing static selection environments having a fixed number of non-moving objects. As a result, the dynamic environment of the embodiment provides an ongoing visual cue for commencing or continuing the selection process.

When an object moves out of the defined area 2201 the associated trajectory becomes available for selection in a next random selection made by the processor 204.

When a selection is received by the processor 204 at step 1540 the processor removes the selected object from the display at step 1550. Processor 204 also removes the selected trajectory such that the total number of trajectories decreases as the player makes selections.

In an example embodiment, at step 1505, the processor 204 determines a prize award path from a weighted table of possible prize award paths. Each prize award path defines an ultimate prize that will be awarded as well as a path that will be taken to reach that award including a number of moving symbols that will be selected before a prize is awarded.

In this respect, referring to FIG. 22 it will be apparent that there are a number of prize award indicators 2251-2255 corresponding to respective ones of the available jackpot prizes 1121-1124 and a play again prize 2253. Below each of these are indicators 2251-2255 which indicate the current state of a prize. In an example of the embodiment, each time an object is selected, a coin is released from these objects and is moved to one of the prize indicators. If the play again prize receives a coin during the current feature game, the player is awarded a further feature game at step 1565. Otherwise the play continues until coins have filled one of the indicators. That is, in this example, until three coins have been selected for one of the prizes. Each of the prize award pathways defines a number of coins that will be allocated to a particular prize before one of the prizes is awarded. In this example, it does not matter which object is selected as what action will be taken by processor 204 is linked to the selection number rather than the object.

Each pathway may or may not include an award of the play again prize 2253. From the above it will be appreciated that each selection of an object either results in a continuation of the prize award process because there are further steps to follow along the path or results in the termination of the prize award process because a prize has been awarded. A skilled person would appreciate that, in the example shown in FIG. 22, the maximum number of selections before a prize needs to be awarded is 10 (i.e. 2 coins collected for each of grand, major, minor, mini, plus 1 coin collected for the play again prize, plus a third coin selected for the awarded prize). In this example, the processor 204 controllably varies the number of unselected trajectories between 4 and 7 so that the visibly moving objects are initially between 11 and 14, and allowing at least one moving object (and up to four) to remain after a maximum of 10 coins are collected—e.g., so that the player is always able to make a choice in respect of the last object. Put another way, the processor 204 controls the maximum and minimum number of active objects within the defined area 2201 at all times.

Referring again to FIG. 15, at step 1560, the processor 204 determines whether play again has been awarded at step 1560, and if it has, it awards a further feature 1565. At step 1570, the processor 204 determines whether a prize has been awarded and if not it reverts to step 1540 to 1570 and continues to move the objects within the area until a prize is awarded. At step 1580, the processor 204 makes any prize determined to be awarded at step 1570 before proceeding to step 1590 and determining whether a further feature is to be conducted based on any feature awarded at step 1565.

If a further feature has been awarded the processor 204 reverts to step 1505 and determines a further prize award path. If no further feature is awarded, at step 1590, the processor proceeds to step 370 and the feature game ends.

In an alternative example, rather than determining a prize award path, the processor 204 determines independently each time an object is selected which prize indicator 2251-2255 will be updated by selecting randomly from weighted table without replacement and the process ends when a prize indicator is completed 2251-2255.

As indicated above, there may be more than one trigger. In a further example, there is a free game trigger which occurs if three or more scatter symbols appear on the reels.

In embodiments of the disclosed technology, this feature game is known as a free games feature and each of the selections that are available involve a number of free games.

Referring to FIG. 16, in embodiments of the disclosed technology, the options available to the player are constrained by a player's selection of a base game option, in this example, based on the number of "Dragon" reels selected as described in relation to FIG. 3. FIG. 16 is an example screen display 1600 of a game rules screen explaining that there are four feature game options 1601-1604 available to the player and that each of these is associated with a particular base game option which results in the configuration of the reels described above. A message 1610 indicates to the player that the prize symbols and bonus symbol do not appear on the reel strips during this feature game.

A first feature game option 1601 is that when the player plays one Dragon reel in the base game when the free games features triggers they have the option of selecting 18 Dragon reel free games where all wins are multiplied by two. A second feature option 1602 is linked to the base game option of playing two Dragon reels and results in the player being awarded twelve Dragon free games where all wins are multiplied by three. A third feature game option 1603 is linked to the base game option of playing three Dragon reels and provides ten Dragon free games where all wins are multiplied by five. Finally, a fourth feature game option 1604 is linked to the base game option of playing four Dragon reels results in the player winning eight Dragon free games where all wins are multiplied by eight.

Figure 17:
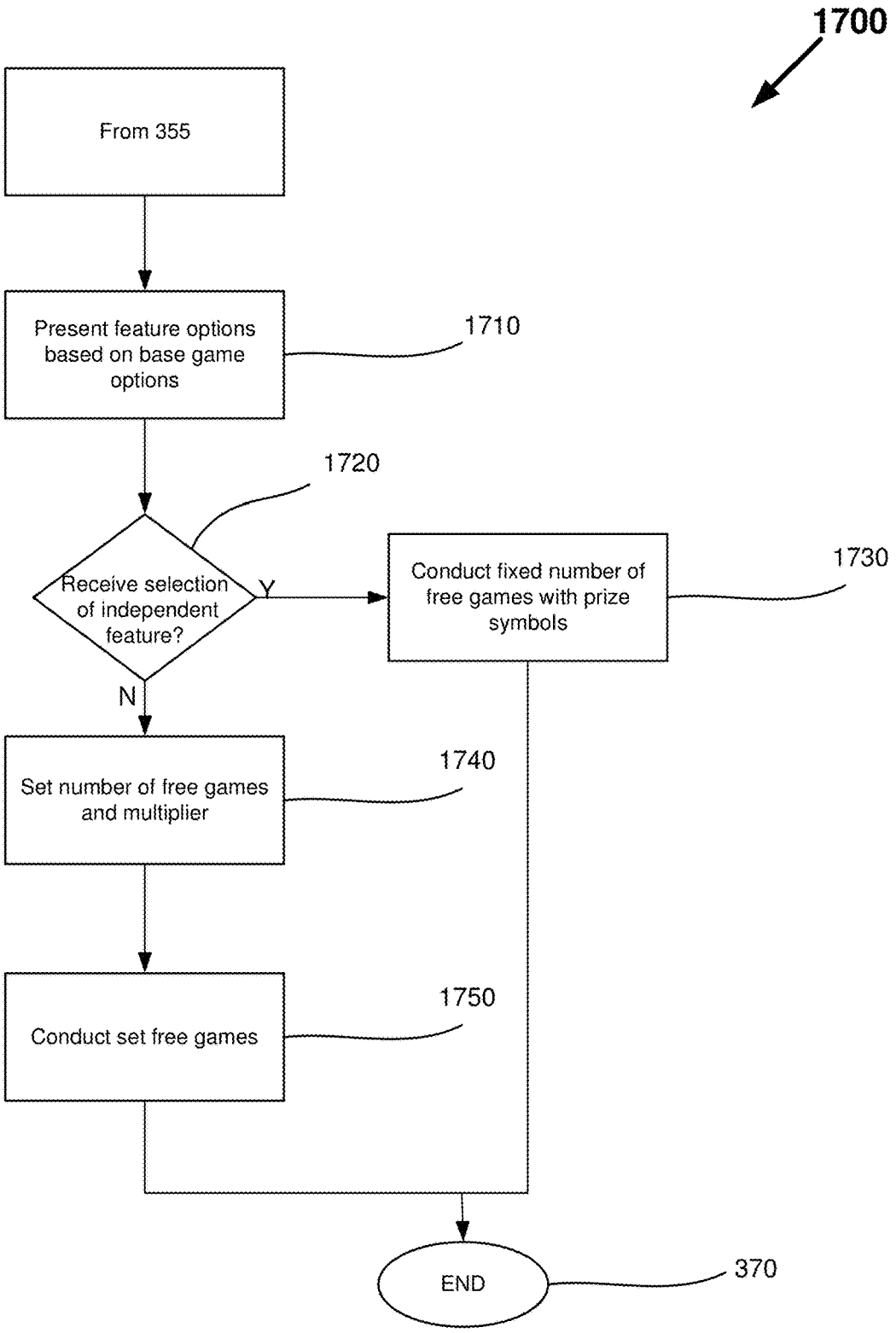
FIG. 17 is a flow chart of another feature game.

In the embodiments, as shown in FIG. 17, when the free games feature game is triggered, the player is presented with feature options to select from based on the selected base game option at 1710. In this example, the player is presented with the free feature game option associated with base game option that the player selected and a further independent feature game option which, in this example, is a defined number of free games which is conducted with prize symbols on the reels and the fifth reel configured so that a designated symbol will appear each time the reels are spun (e.g. with a designated symbol at every third reel strip position.)

Accordingly, if for example the player has elected to play four Dragon reels as shown in the example of FIGS. 8 and 9, at step 1710, the player will be presented with the option to play eight Dragon games with all wins multiplied by 8 or to play the fixed number of free games with prize symbols. At step 1720, the processor 204 determines whether it has received the selection of the independent feature. If the processor 204 receives the selection of the independent feature the processor proceeds to step 1730 and conducts the fixed number of free games with prize symbols before the game ends 370.

Alternatively, if the player does not select the independent feature, the processor proceeds to step 1714 and sets a number of free games and a multiplier to apply based on the feature game option that is available to the player based on their base game selection. At step 1750 processor 204 conducts the set number of free games and evaluates winning combinations by applying the set multiplier before the game ends at step 370.

In the example, at step 1570, based on the player's bet, the free game series when triggered is varied in terms of: (a) number of free games N, (b) win multiplier M and (c) number of Dragon reels (P). In general, a higher player's bet corresponds to a higher N×M, N×P, M×P or N×M×P Note that this is not a volatility choice at the start of the free spins (as per game 2), but is set upon the player's bet selection. Higher values N, M and P correspond to a better free game option. For example, more free games (i.e. higher N) and/or a larger win multiplier (i.e. higher M) correspond to a higher expected reward. As indicated above in relation to FIG. 19, each Dragon reel is modified into an expanded wild column upon landing a wild symbol on that reel, with a higher P corresponding to more expected wild columns during the free games, hence higher expected reward. In general, a higher number of Dragon reels P corresponds to a higher metric of any one or more of these products: N×M, N×P, M×P and N×M×P. For example, referring to FIG. 16, the product metrics of each of the four free game options, each of which depends on the number of Dragon reels P, are shown in Table 1.

TABLE 1

| P | N × M | N × P | M × P | N × M × P |
|---|---|---|---|---|
| 1 | 18 × 2 = 36 | 18 × 1 = 18 | 2 × 1 = 2 | 18 × 2 × 1 = 36 |
| 2 | 12 × 3 = 36 | 12 × 2 = 24 | 3 × 2 = 6 | 12 × 3 × 2 = 72 |
| 3 | 10 × 5 = 50 | 10 × 3 = 30 | 5 × 3 = 15 | 10 × 5 × 3 = 150 |
| 4 | 8 × 8 = 64 | 8 × 4 = 32 | 8 × 4 = 32 | 8 × 8 × 4 = 256 |

While the disclosed technology has been described with respect to the figures, it will be appreciated that many modifications and changes may be made by those skilled in the art without departing from the spirit of the invention. Any variation and derivation from the above description and figures are included in the scope of the present invention as defined by the claims.

What is claimed is:

1. Computer-readable memory having stored thereon computer-executable instructions for causing one or more processors, when programmed thereby, to perform operations to control a user interface of an electronic gaming device, the operations comprising, for a game instance:

configuring multiple reel strips, the multiple reel strips including a bonus reel strip and one or more configurable reel strips, wherein a designated symbol is assigned to each of multiple reel strip positions of the bonus reel strip, and wherein the configuring the multiple reel strips includes:

determining a number of configurable reel strips; and for each of one or more configurable reel strips, among the number of configurable reel strips and different than the bonus reel strip, configuring a configurable reel strip by iterative operations, the iterative operations including, for each of multiple dynamically configurable reel strip positions of the configurable reel strip:

determining a value from a random number generator ("RNG");

selecting a prize symbol, from a set of prize symbols, based on the value from the RNG and a weighted table in which each of the set of prize symbols is associated with a probability of that prize symbol being selected, the set of prize symbols including a first prize symbol and a second prize symbol; and assigning the selected prize symbol to a reel strip position of the configurable reel strip;

selecting multiple symbols from each of the multiple reel strips;

generating data for displaying selected symbols of each of the multiple reel strips in a corresponding column of symbol positions; and evaluating the selected symbols for winning combinations that include the designated symbol and any of the set of prize symbols, wherein a first prize is awarded if the selected symbols include a winning combination for the first prize, the winning combination for the first prize including the designated symbol and the first prize symbol, and wherein a second prize is awarded if the selected symbols include a winning combination for the second prize, the winning combination for the second prize including the designated symbol and the second prize symbol.

2. The computer-readable memory of claim 1, wherein the operations further comprise determining a level of a wager, wherein the number of configurable reel strips is based on the level of the wager.

3. The computer-readable memory of claim 2, wherein different selectable wagers are associated with different numbers of configurable reel strips.

4. The computer-readable memory of claim 1, wherein the number of configurable reel strips is a single configurable reel strip.

5. The computer-readable memory of claim 4, wherein the evaluating the selected symbols for winning combinations proceeds from a leftmost column of symbol positions to a rightmost column of symbol positions, the single configurable reel strip being associated with the leftmost column of symbol positions, and the bonus reel strip being associated with the rightmost column of symbol positions.

6. The computer-readable memory of claim 1, wherein the number of configurable reel strips is two or more configurable reel strips.

7. The computer-readable memory of claim 6, wherein the evaluating the selected symbols for winning combinations proceeds from a leftmost column of symbol positions to a rightmost column of symbol positions, one of the two or more configurable reel strips being associated with the leftmost column of symbol positions, and the bonus reel strip being associated with another column of symbol positions.

8. The computer-readable memory of claim 1, wherein the configuring the multiple reel strips further includes configuring the bonus reel strip so that the designated symbol is assigned to each of the multiple reel strip positions of the bonus reel strip.

9. The computer-readable memory of claim 1, wherein the first prize and the second prize are progressive jackpot prizes, an initial value of the first prize and an initial value of the second prize having a same value, the first prize and the second prize being incremented at a same rate based on wagers received.

10. A method of controlling a user interface of an electronic gaming device, the method comprising, for a game instance:

configuring multiple reel strips, the multiple reel strips including a bonus reel strip and one or more configurable reel strips, including:

configuring the bonus reel strip so that a designated symbol is assigned to each of multiple reel strip positions of the bonus reel strip;

determining a number of configurable reel strips; and for each of the one or more configurable reel strips, among the number of configurable reel strips and different than the bonus reel strip, configuring a configurable reel strip by iterative operations, the iterative operations including, for each of multiple dynamically configurable reel strip positions of the configurable reel strip:

determining a value from a random number generator ("RNG");

selecting a prize symbol, from a set of prize symbols, based on the value from the RNG and a weighted table in which each of the set of prize symbols is associated with a probability of that prize symbol being selected, the set of prize symbols including a first prize symbol and a second prize symbol; and assigning the selected prize symbol to a reel strip position of the configurable reel strip;

selecting multiple symbols from each of the multiple reel strips;

generating data for displaying selected symbols of each of the multiple reel strips in a corresponding column of symbol positions; and evaluating the selected symbols for winning combinations that include the designated symbol and any of the set of prize symbols, wherein a first prize is awarded if the selected symbols include a winning combination for the first prize, the winning combination for the first prize including the designated symbol and the first prize symbol, and wherein a second prize is awarded if the selected symbols include a winning combination for the second prize, the winning combination for the second prize including the designated symbol and the second prize symbol.

11. The method of claim 10, further comprising determining a level of a wager, wherein the number of configurable reel strips is based on the level of the wager.

12. The method of claim 11, wherein different selectable wagers are associated with different numbers of configurable reel strips.

13. The method of claim 10, wherein the number of configurable reel strips is a single configurable reel strip, and wherein the evaluating the selected symbols for winning combinations proceeds from a leftmost column of symbol positions to a rightmost column of symbol positions, the single configurable reel strip being associated with the leftmost column of symbol positions, and the bonus reel strip being associated with the rightmost column of symbol positions.

14. The method of claim 10, wherein the number of configurable reel strips is two or more configurable reel strips, and wherein the evaluating the selected symbols for winning combinations proceeds from a leftmost column of symbol positions to a rightmost column of symbol positions, one of the two or more configurable reel strips being associated with the leftmost column of symbol positions, and the bonus reel strip being associated with another column of symbol positions.

15. The method of claim 10, wherein the first prize and the second prize are progressive jackpot prizes, and wherein the method further comprises:

setting an initial value of the first prize and an initial value of the second prize at a same value, and incrementing each of the first prize and the second prize at a same rate based on wagers received; and upon awarding one of the first prize and the second prize, resetting a respective one of the first and the second prizes to the initial value, and continuing to increment each of the first prize and the second prize at the same rate based on subsequent wagers received.

16. Computer-readable memory having stored thereon computer-executable instructions for causing one or more processors, when programmed thereby, to perform operations to control a user interface of an electronic gaming device, the operations comprising:

setting a value of a first prize at an initial value;

setting a value of a second prize at the initial value, the initial value being the same for the first prize and the second prize;

causing the value of the first prize and the value of the second prize to be displayed; and for each of multiple wagers in response to player selections:

incrementing the value of the first prize and the value of the second prize at a same rate based on a wager, the value of the first prize and the value of the second prize being incremented at the same rate based on successive wagers;

causing the incremented values to be displayed, thereby facilitating a pendulum effect between awarding the first prize and awarding the second prize;

selecting, based at least in part on values from a random number generator ("RNG"), a plurality of symbols from each of a plurality of reel strips;

causing selected symbols of each of the plurality of reel strips to be displayed in a corresponding column of symbol positions;

evaluating the selected symbols for any winning combinations, including determining whether the selected symbols include a winning combination for the first prize and determining whether the selected symbols include a winning combination for the second prize;

if the selected symbols include the winning combination for the first prize, awarding the first prize and resetting the value of the first prize to the initial value; and if the selected symbols include the winning combination for the second prize, awarding the second prize and resetting the value of the second prize to the initial value.

17. The computer-readable memory of claim 16, wherein the first prize and the second prize are progressive jackpot prizes.

18. The computer-readable memory of claim 16, wherein at least one of the plurality of reel strips comprises a designated symbol, wherein the winning combination for the first prize includes the designated symbol and a first prize symbol associated with the first prize, and wherein the winning combination for the second prize includes the designated symbol and a second prize symbol associated with the second prize.

19. The computer-readable memory of claim 16, further comprising, for each of the multiple wagers in response to the player selections:

determining a number of configurable reel strips; and for each of one or more configurable reel strips, among the number of configurable reel strips, configuring a configurable reel strip.

20. The computer-readable memory of claim 19, wherein the configuring the configurable reel strip includes, for each of multiple dynamically configurable reel strip positions of the configurable reel strip:

determining a value from the RNG;

selecting a prize symbol, from a set of prize symbols, based on the value from the RNG and a weighted table in which each of the set of prize symbols is associated with a probability of that prize symbol being selected, the set of prize symbols including a first prize symbol associated with the first prize and a second prize symbol associated with the second prize; and assigning the selected prize symbol to a reel strip position of the configurable reel strip.

* * * * *